US006079816A

United States Patent [19]

Nakamura et al.

[11] Patent Number: 6,079,816

[45] Date of Patent: Jun. 27, 2000

[54] ELECTROSTATIC IMAGE FORMING APPARATUS HAVING CONTROL ELECTRODE PROTECTION MEANS

[75] Inventors: Takeshi Nakamura, Yamatokoriyama; Hironori Ogasawara; Nobuhiko Nakano, both of Nara; Hiroshi Kuranaga, Yamatokoriyama, all of Japan

[73] Assignee: Sharp Kabushika Kaisha, Osaka, Japan

[21] Appl. No.: 09/021,159

[22] Filed: Feb. 10, 1998

[30] Foreign Application Priority Data

Feb. 19, 1997 [JP] Japan ..... 9-035171

[51] Int. Cl.[7] ..... B41J 2/06

[52] U.S. Cl. ..... 347/55

[58] Field of Search ..... 347/55, 151, 120, 347/141, 154, 159, 127, 128, 103, 123, 111, 17; 399/271, 290, 292, 293, 294, 295

[56] References Cited

U.S. PATENT DOCUMENTS

| | | | |
|---|---|---|---|
| 5,122,838 | 6/1992 | Kohyama . | |
| 5,296,879 | 3/1994 | Kagayama . | |
| 5,365,315 | 11/1994 | Baker et al. . | |
| 5,495,273 | 2/1996 | Kitamura | 347/55 |
| 5,559,544 | 9/1996 | Sato | 347/127 |

FOREIGN PATENT DOCUMENTS

| | | |
|---|---|---|
| 0 467 418 A1 | 1/1992 | European Pat. Off. . |
| 58-215372 | 12/1983 | Japan . |
| 59-034555 | 2/1984 | Japan . |
| 60-063549 | 4/1985 | Japan . |
| 2-262675 | 10/1990 | Japan . |
| 5-286166 | 11/1993 | Japan . |
| 6-305180 | 11/1994 | Japan . |
| 8-108566 | 4/1996 | Japan . |

*Primary Examiner*—John Barlow
*Assistant Examiner*—Raquel Yvette Gordon
*Attorney, Agent, or Firm*—David G. Conlin; David A. Tucker; Dike, Bronstein, Roberts & Cushman, LLP

[57] ABSTRACT

An image forming apparatus includes an opening and closing member mounted to an apparatus main body so that it can be open and closed, and a head cover for protecting the surface of a control electrode when opening the opening and closing member without disturbing an operation of controlling the flying of a toner by the control electrode in a closed state of the opening and closing member as being moved interlocking with opening and closing operations of the opening and closing member. According to the described arrangement, when the opening and closing member is open to remove a jammed sheet, exchange a toner cartridge, carry out various checking for printing inferior or install and remove a unit including the control electrode with respect to the apparatus main body, the control electrode which would be exposed otherwise can be prevented from being touched with an operator's finger or other member of the apparatus, etc.

35 Claims, 14 Drawing Sheets

ELECTROSTATIC IMAGE FORMING APPARATUS HAVING CONTROL ELECTRODE PROTECTION MEANS

FIELD OF THE INVENTION

The present invention relates to an image forming apparatus for forming an image on a recording material directly by flying toner as a developer material, for use in, for example, a printer section of a digital copying machine, a facsimile machine, or a digital printer, a plotter, etc.

BACKGROUND OF THE INVENTION

Conventionally, various types of image forming apparatuses wherein a visible image is formed directly on a recording material such as a sheet, etc., by flying toner (developing material) based on an image signal have been proposed. The described image forming apparatuses include at least a toner holding member for holding toner in one color, a counter electrode placed opposing the toner holding member, and a control electrode having a plurality of opening sections which serve as toner passing holes, the control electrode being placed between the toner holding member and the counter electrode. These apparatuses are arranged so as to control a flying of the toner by varying a potential to be applied to the control electrode.

After the described image forming apparatuses have been used for a long period of time, such problem that the toner adheres to the opening sections of the control electrode, or irregularities in the resulting image would occur. In order to eliminate the described problems, it is required to clean up the control electrode periodically by taking it out from the apparatus main body, or exchange the control electrode with new control electrode.

For example, Japanese Unexamined Patent Publication No. 336049/1994 (Tokukaihei 6-336049) discloses an image forming apparatus wherein a control electrode and a toner holding member are mounted to the first flame which is mounted to the apparatus main body, and a counter electrode is mounted to the second flame which is axially supported by the apparatus main body so as to be rotatable relative to the first flame.

According to the described arrangement, when rotating the second flame relative to the first flame, by making these flames apart from one another, the counter electrode and the control electrode apart from one another. As a result, the control electrode is exposed, and a cleaning up of the control electrode can be performed with ease.

Additionally, in the conventional image forming apparatus, when a damage occurs in some members of the apparatus, or the life of some members are ended, and a removal and exchange of these members are required, as the members of the apparatus are provided independently, a long time is required for the removal or the exchange operation, and such operation cannot be performed efficiently.

In order to counteract the described problems, Japanese Unexamined Patent Publication No. 67961/1992 (Tokukaihei 4-67961) teaches that at least two of the toner holding member, the counter electrode and the control electrode are formed in a unit. According to the described arrangement, when a member within the unit is damaged, or its life is ended, and an exchange of such fault member is required, as such member can be exchanged in a unit, the process for the exchange operation of the fault member can be simplified, and the burden of the user can be reduced.

For example, Japanese Unexamined Patent Publication No. 286166/1993 (Tokukaihei 5-286166) discloses an arrangement wherein toner supply means with a toner holding member and a control electrode are integrated, so as to permit both to be removed at the same time. The structure of this Publication also permits the control electrode to be removed independently. According to the described arrangement, only the control electrode can be exchanged without taking out the toner supply means from the apparatus main body, and the toner supply means can be used to the end of its life. This can eliminate such problem that the member which can be still used has to be exchanged together with the fault member or the member which has been used to the end of its life can be eliminated.

Japanese Unexamined Patent Publication No. 305180/1994 (Tokukaihei 6-305180) discloses a recording device in which the control electrode and the counter electrode are integrated. According to the described arrangement, a constant interval is maintained between the control electrode and the counter electrode.

Specifically, in the case where the toner supply means and the control electrode are integrated, when exchanging the unit for a supply of the toner, it is likely that a small interval (for example, 0.5 mm) formed between the control electrode and the counter electrode varies. As a result, a path for the toner which passes through the opening sections of the control electrode varies, which causes irregularities of the toner image. Especially, when the interval becomes smaller than the predetermined distance, an insulating brakedown would occur between the control electrode and the counter electrode, which may cause the problem that a recording operation can no longer be performed by the apparatus.

Therefore, according to the described image forming apparatus, as the interval between the control electrode and the counter electrode can be maintained always constant, a flying of the toner can be controlled under stable conditions, thereby permitting an image forming operation to be performed under stable conditions.

The structure which offers a constant interval between the control electrode and the counter electrode is also disclosed by Japanese Unexamined Patent Publication No. 255161/1994 (Tokukaihei 6-255161). Namely, according to the recording device of this Publication, by providing the spacer between the portion outside the recording region of the control electrode and the counter electrode, the interval can be maintained constant to control a flying of a toner under stable conditions.

For example, Japanese Unexamined Patent Publication No. 108566/1996 (Tokukaihei 8-108566) discloses a printer unit wherein at least two toner holding members and the control electrode divided in a number of the toner holding members are formed in a unit. According to the described arrangement, by providing the divided control electrodes corresponding to the respective toner holding members, a reduction in amount of the toner passing through the opening section of the control electrode can be prevented. As a result, such problem that a bright line appears in an image, i.e., a so-called white line noise can be eliminated.

Additionally, in the printer unit, by reducing an area for each control electrode by dividing the control electrode, such problem that a concentration of a black color varies especially when printing an image of a large area, i.e., a so-called a curtain effect can be eliminated.

However, according to the described arrangement of Japanese Unexamined Patent Publication No. 336049/1994 (Tokukaihei 6-336049), for example, when removing a jammed sheet, exchanging the toner cartridge, or performing various checks for printing inferior by opening the second flame provided so as to be capable of opening and closing, the control electrode is always exposed. Therefore, when a finger of the operator, etc., touches the control electrode, the surface of the control electrode is soiled or damaged.

Additionally, in each of the described conventional arrangements, for example, when a unit including, for example, the control electrode is removed from the apparatus, as the surface of the control electrode is not protected, the control electrode may be damaged due to an contact with other member.

As described, according to the conventional arrangement, a flying of the toner cannot be controlled desirably due to a damage of the control electrode. As a result, desirable printing performances cannot be maintained.

SUMMARY OF THE INVENTION

It is an object of the present invention to provide an image forming apparatus which offers desirable printing performances by preventing a control electrode from being damaged due to a contact with an external section.

In order to achieve the above object, an image forming apparatus in accordance with the present invention is characterized by including:

a holding member for holding a developing material;

a counter electrode opposing the holding member;

a control electrode for controlling a flying of the developing material by varying an electric field between the holding member and the counter electrode;

an opening and closing member which can be open and closed with respect to an apparatus main body of the apparatus; and control electrode protection means which can be moved interlocking with opening and closing operations of the opening and closing member so as to protect a surface of the control electrode when opening the opening and closing member in such a manner that an operation of the control electrode of controlling the flying of the developing material cannot be disturbed in a closed state of the opening and closing member.

According to the described arrangement, in the image forming apparatus which controls a flying of a developing material from the holding member to the counter electrode by varying the electric field between the holding member and the counter electrode under the control of the control electrode, when opening the opening and closing member, the control electrode protection means is moved so as to protect the control electrode interlocking with the opening operation of the opening and closing member.

As a result, for example, when the opening and closing member is open to remove a jammed sheet, exchange the toner cartridge, or to perform various checking for the printing inferior, the control electrode which would be exposed otherwise can be prevented from having a direct contact of a finger of an operator, other member, etc.

On the other hand, when closing the opening and closing member, the control electrode protection means is moved interlocking with the closing operation of the opening and closing member so as to allow the control electrode to control the flying of the developing material from the holding member to the counter electrode. As this permits the developing material to fly without being disturbed by the control electrode protection means, a normal image forming operation can be performed.

Therefore, according to the arrangement of the present invention, the surface of the control electrode can be prevented from soiling or being damaged due to a contact with other member when carrying out various checking operations. As a result, the flying of the developing material can be always controlled under stable conditions, thereby maintaining a desirable printing performance.

The novel features which are considered as characteristic of the invention are set forth in particular in the appended claims. The improved treatment method, as well as the construction and mode of operation of the improved treatment apparatus, will, however, be best understood upon perusal of the following detailed description of certain specific embodiments when read in conjunction with the accompanying drawings.

BRIEF DESCRIPTION OF THE DRAWINGS

FIG. 5(*b*) is a perspective view showing a state where the control electrode protection means is moved so as to open the upper surface of the control electrode interlocking with a closing operation of the opening and closing member;

DESCRIPTION OF THE EMBODIMENTS

[EMBODIMENT 1]

The following descriptions will explain one embodiment of the present invention in reference to figures through an example of an image forming apparatus having a structure designed for a negatively charged toner. However, the present invention is not limited to this arrangement, and may be suitably applied to the case of adopting a positively charged toner by suitably selecting a polarity of an application voltage according to the polarity of the toner charged.

Figure 2:
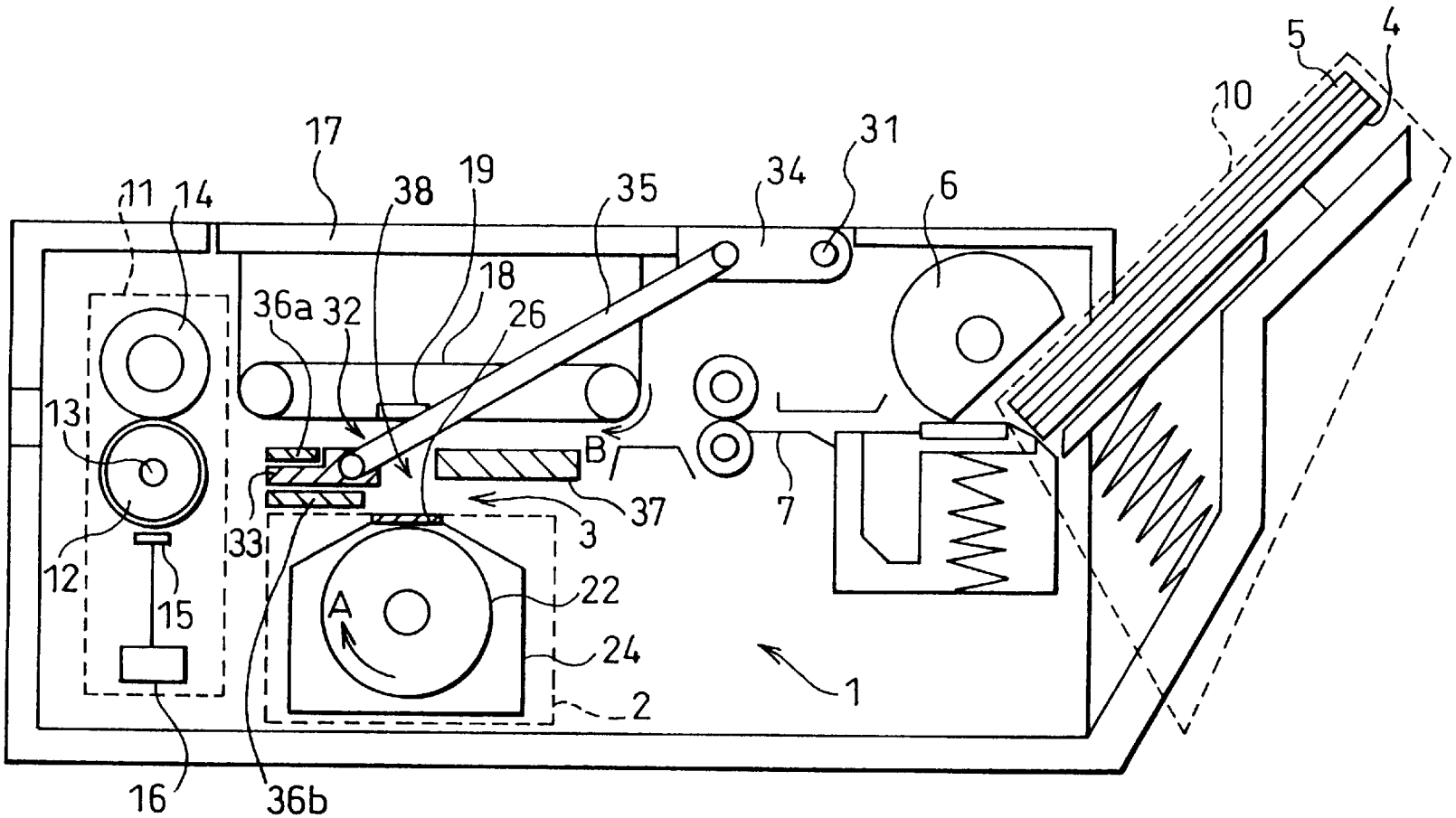
FIG. 2 is a cross-sectional view showing a schematic structure of the image forming apparatus of FIG. 1.

As shown in FIG. 2, an image forming apparatus in accordance with the present embodiment has an image forming section 1 which includes a toner supply section 2 and a printing section 3. The image forming section 1 is arranged such that an image based on an image signal is visualized onto a sheet 5 (printing material) using a toner (developing material). Namely, according to the image forming apparatus of the present embodiment, an image is formed directly onto the sheet 5 by making the toner fly to adhere to the sheet 5.

At the position from which the sheet 5 is to be fed onto the image forming section 1, a feed unit 10 is provided. The feed unit 10 includes a sheet cassette 4 for storing the sheet 5 (printing material), a pickup roller 6 for feeding the sheet 5 from the sheet cassette 4, and a feed guide 7 for guiding the sheet 5 as fed. The feed unit 10 includes a feed sensor (not shown) for detecting if the sheet 5 has been fed. The pickup roller 6 is rotatably driven by a drive unit (not shown).

To the position where the sheet 5 is discharged from the image forming section 1, a fixing section 11 is provided. The fixing section 11 includes a heat roller 12, a heater 13, a pressure roller 14, a temperature sensor 15, and a temperature control circuit 16. The toner image formed on the sheet 5 by the image forming section 1 is made affixed onto the sheet 5 with applications of heat and pressure.

The heat roller 12 is made of an aluminum tube with a thickness of, for example, 2 mm. The heater 13 is composed of, for example, a halogen lamp, and is provided in the heat roller 12. The pressure roller 14 is made of, for example, silicone resin, and is placed opposite the heat roller 12. To the heat roller 12 and the pressure roller 14, a load of, for example, 2 kg is applied by, for example, springs (not shown) mounted to both ends of the respective shafts so that these rollers can sandwich and press the sheet 5. The temperature sensor 15 is provided for measuring the temperature on the surface of the heat roller 12. The temperature control circuit 16 controls ON/OFF of the heater 13 based on the result of measurement by the temperature sensor 15, and the temperature of the heat roller 12 is maintained at, for example, 150° C.

The fixing section 11 includes a discharge sensor (not shown) for detecting the sheet 5 as discharged. The respective materials for the heat roller 12, the heater 13 and the pressure roller 14, etc., are not particularly limited. The temperature of the surface of the heat roller 12 is not particularly limited. Further, the fixing section 11 is arranged such that the toner image is made permanently adhere to the sheet 5 by applying either heat or pressure to the sheet 5.

Although not shown, a discharge section for discharging the sheet 5 from the fixing section 11 includes discharge rollers for discharging the sheet 5 processed with the fixing section 11 onto a discharge tray, and the discharge tray for receiving the sheet 5 as discharged. The described heat roller 12, the pressure roller 14 and the discharge rollers are rotatably driven by a drive device (not shown).

The toner supply section 2 of the image forming section 1 includes a toner storage vessel (not shown) for storing the toner, a toner holding member 22 (holding member) of a cylindrical sleeve for holding the toner with a magnetic force, a doctor blade (not shown) for regulating the thickness of the toner layer for holding the toner as charged onto the peripheral surface of the toner holding member 22, and a control electrode 26 placed in a toner flying path between the toner holding member 22 and the counter electrode 19 (to be described later).

Both the toner holding member 22 and the doctor blade are provided within a toner holding member storage vessel 24 (holding member storage vessel), and the toner storage vessel is incorporated so as to be detachable from the toner holding member storage vessel 24. The control electrode 26 is integrated within the toner holding member storage vessel via the control electrode base (not shown).

The toner adopted in the present embodiment is a magnetic toner having an average particle diameter of, for example, 6 $\mu$m. By the doctor blade, a charge is given to achieve an amount of charge, for example, in a range of from −4 $\mu$C/g to −5 $\mu$C/g. However, the average particle diameter and the amount of charge of the toner are not particularly limited.

The toner holding member 22 is driven, for example, by the drive unit (not shown), and is rotated in a direction of an arrow A at a peripheral speed of 80 mm/sec. The toner holding member 22 is connected to ground, and a magnet (not shown) is provided at the position opposite the counter electrode 19 within the toner holding member 22. As a result, the toner is held on the peripheral surface of the toner holding member 22, and a toner brush is formed at position opposite the counter electrode 19.

The rotation speed of the toner holding member 22 is not particularly limited. It is not necessarily that the toner holding member 22 holds the toner by the magnetic force, and the same may be held by an electric force, or by both the electric force and the magnetic force.

The doctor blade is provided, for example, at position 60 $\mu$m apart from the peripheral surface of the toner holding member 22 at the downstream side of the toner storage vessel in a rotating direction of the toner holding member 22. The distance between the doctor blade and the toner holding member 22 is not particularly limited. The detailed descriptions of the control electrode 26 will be given later.

The printing section 3 of the image forming section 1 is composed of a dielectric belt 18, and an aluminum plate with a thickness of, for example, 1 mm. The printing section 3 includes the counter electrode 19 placed opposite the peripheral surface of the toner holding member 22 and a high voltage power supply (not shown) for supplying a high voltage to the counter electrode 19.

For the dielectric belt 18, PVDF (polyvinylidene fluoride) is used as a base material, and the dielectric belt 18 has the volume resistivity of $10^{10}\Omega\cdot$cm, and a thickness of 75 $\mu$m. The dielectric belt 18 is driven by a drive unit (not shown), and to rotate, for example, in a direction of an arrow B at a moving speed of the surface of 30 mm/sec. Here, the moving speed of the dielectric belt 18 is not particularly limited.

The counter electrode 19 is provided at position, for example, 1.1 mm apart from the peripheral surface of the toner holding member 22. To the counter electrode 19, a high voltage of, for example, 2.3 kV is applied from the high voltage power supply, thereby generating an electric field required for making the toner fly from the toner holding member 22 towards the counter electrode 19.

The material for the counter electrode 19, the voltage to be applied to the counter electrode 19, and a distance between the counter electrode 19 and the toner holding member 22 are not particularly limited.

The dielectric belt 18 and the counter electrode 19 are integrally formed with a flame (hereinafter referred to as an opening and closing member 17) which can be open and closed by rotating about the shaft 31 (fulcrum) of the apparatus main body. Therefore, for example, by an opening operation of the opening and closing member 17, a removal of a jammed sheet, or an exchange of the toner cartridge can be performed. The opening and closing member 17 functions as an opening and closing mechanism for opening and closing the inside of the apparatus main body.

Figure 3:
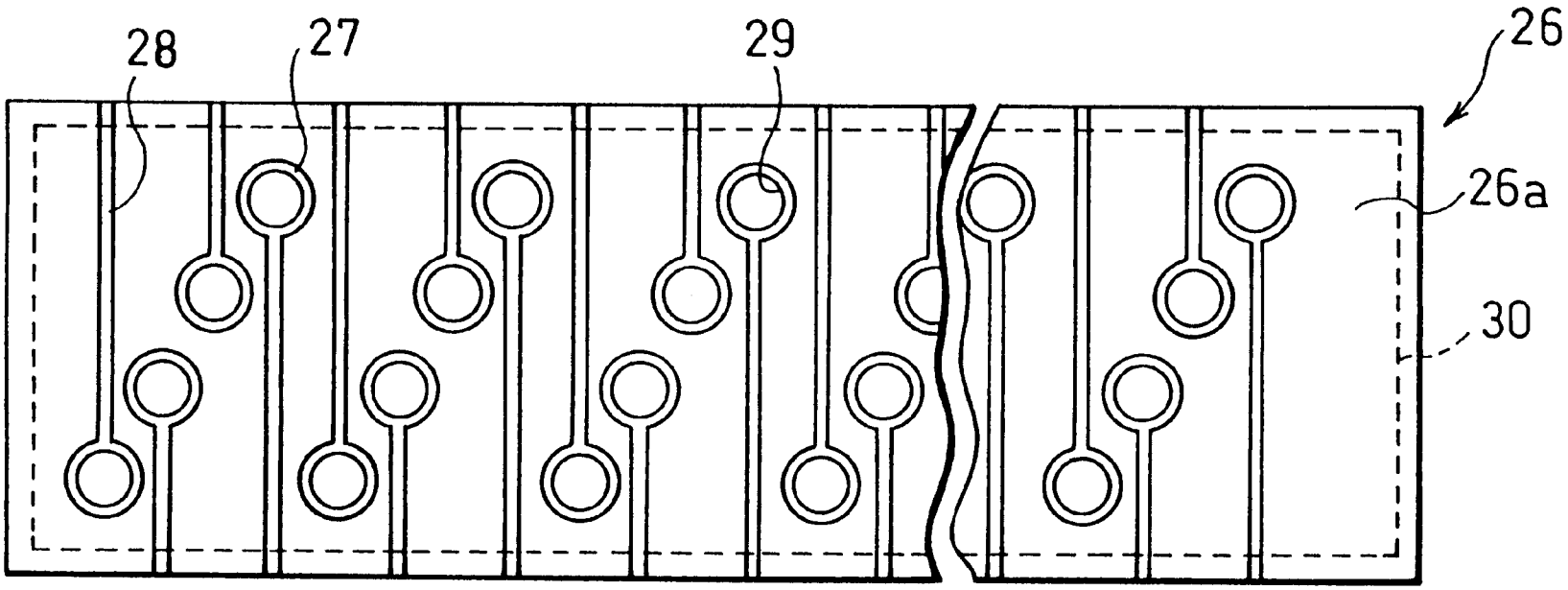
FIG. 3 is a plan view showing a schematic structure of a control electrode provided in the image forming apparatus.

The control electrode 26 is formed parallel to the contact face on the peripheral surface of the counter electrode 19, and is formed two-dimensionally opposite the counter electrode 19. The control electrode 26 is provided in such a manner that the toner can fly towards the counter electrode 19 from the toner holding member 22 through the control electrode 26. By the potential to be supplied to the control electrode 26, an electric field generated between the toner holding member 22 and the counter electrode 19 varies, and a flying of the toner from the toner holding member 22 to the counter electrode 19 is controlled. The control electrode 26 is fixed to a control electrode base (not shown), for example, at 100 μm apart from the peripheral surface of the toner holding member 22. As shown in FIG. 3, the control electrode 26 includes an insulating substrate 26*a*, an independent ring-shaped electrically conductive member, i.e., the ring-shaped electrodes 27 and the high voltage driver (not shown).

The substrate 26*a* is made of, for example, polyimide resin, and is a flexible print substrate (FPC) having a thickness of, for example, 25 μm. On the substrate 26*a*, a plurality of holes which serve as a passing section of the toner for allowing the toner to fly from the toner holding member 22 to the counter electrode 19. Hereinafter, the passing section is referred to as gates 29. Each gate 29 has a diameter of, for example, 160 μm.

The ring-shaped electrodes 27 are made of a copper foil, in a thickness of, for example, 18 μm. The ring-shaped electrodes 27 are formed in the peripheral portion of the gates 29 on the surface on the side of the counter electrode 19 on the substrate 26*a* in a predetermined arrangement. The opening section of each ring-shaped electrode 27 is formed so as to have a diameter of, for example, 200 μm.

The distance between the control electrode 26 and the toner holding member 22 is not particularly limited. The size of the gates 29, and the material, the thickness, etc., of the substrate 26*a* and the ring-shaped electrode 27 are not particularly limited.

Additionally, at position corresponding to the gates 29 on the surface of the substrate 26*a* on the side of the toner holding member 22, a shield electrode 30 made of copper foil is formed so as to have a thickness of 3 μm. The opening section of the shield electrode 30 is formed so as to have a diameter of, for example, 240 μm.

For example, 2560 ring-shaped electrodes 27 are provided around the circumference of the gates 29. The number corresponds to the resolution 300 DPI (dot per inch) in the width of the A-4 size sheet, but is not particularly limited. The ring-shaped electrodes 27 are electrically connected to the control power supply section (not shown) via feed lines 28 and the high voltage driver.

The respective surfaces of the ring-shaped electrodes 27, the feed lines 28 and the shield electrodes 30 are covered with the insulating layer (not shown) with a thickness of 30 μm. As a result, the insulating property between the ring-shaped electrodes 27, the insulating property between the feed lines 28, and the insulating property between the ring-shaped electrodes 19 as well as the insulating property between the toner holding member 22 and the counter electrode 19 are ensured respectively. Here, the material, the thickness, etc., of the insulating layer are not particularly limited.

To the ring-shaped electrodes 27 of the control electrode 26, a pulse according to an image signal, i.e., a voltage is applied from a control power supply section (not shown). Namely, in order to make the toner held on the toner holding member 22 pass towards the counter electrode 19, the control power supply section applies a voltage of, for example, 150 V to the ring-shaped electrodes 27. Additionally, in order to prevent the toner from passing towards the counter electrode 19, the power supply section applies a voltage of, for example, −200 V to the ring-shaped electrode 27.

To the shield electrode 30 formed on the control electrode 26, a shield potential of −200 V is supplied from the shield power supply (not shown). As a result, the toner adhering to the control electrode 26 is removed with ease. Moreover, the toner can be prevented from adhering the control electrode 26.

As described, with an arrangement where a potential to be applied to the control electrode 26 is controlled according to an image signal, and the sheet 5 is placed on a surface opposing the toner holding member 22 of the counter electrode 19, a toner image is formed on the surface of the sheet 5 according to an image signal. The control power supply section is controlled based on a control electrode control signal as being sent from an image formation control unit (not shown).

Although not shown, the image forming apparatus of the present embodiment includes a main control section as a control circuit, an image processing section, an image information memory, and an image formation control unit. The main control section controls an entire image forming apparatus. The image processing section is provided for converting the image data obtained from the image reading unit for reading the image of the document, etc., into the image data as desired. The image data memory is provided for storing the image data as converted. The image formation control unit converts the image data resulting from the image processing section to the image data to be applied to the control electrode 26.

Next, an image forming operation of the image forming apparatus will be explained in reference to FIG. 2.

First, for example, the document to be copied is set to the image reading section, and a copy start button (not shown) is operated. Then, the main control section which receives the input starts an image forming operation. Namely, the document image is read by the image reading section, and the image data as read is processed with the image processing section, and the image data as processed are stored in the image data memory. The image data as stored in the image data memory are transferred to the image formation control unit. The image formation control unit starts converting the image data as input into a control electrode control signal to be applied to the control electrode 26.

Additionally, when the image formation control unit generates a predetermined amount of the control electrode control signal, the drive unit (not shown) starts driving, which, in turn, rotatably drives the pickup roller 6. When the sheet 5 stored in the sheet cassette 4 is fed by the pickup roller 6 towards the image forming section 1, the feed sensor detects a normal feeding state. The sheet 5 as fed by the pickup roller 6 is guided by a guide 37 (guide means), to be described later, to a surface opposing the toner holding member 22 in sync with the image signal.

In the toner supply section 2, the toner as stored in the toner storage vessel is supplied to the toner holding member 22. The toner as supplied onto the toner holding member 22 is held thereon by a mirror image force, a van der Waals force, a liquid crosslinking force.

Here, the toner on the toner holding member 22 is regulated to form a layer having a thickness as desired by the doctor blade, and the toner is, for example, negatively charged by a friction with the doctor blade. The toner as charged is transported to a toner flying area by the rotations of the toner holding member 22.

In the image formation control unit, an image signal is supplied to the control electrode 26 at a timing in sync with a supplying timing of the sheet 5 to the printer section 3. In the control power supply section, based on the control electrode control signal, a voltage of 150 V or −200 V is applied to each ring-shaped electrode 27 of the control electrode 26 to control an electric field in a vicinity of the control electrode 26. Namely, in the gates 29 of the control electrode 26, a prevention of a flying of the toner from the toner holding member 22 to the counter electrode 19 is switched ON/OFF as desired according to the image data. As a result, a toner image based on the image signal is formed on the sheet 5 as being moved at a speed of 30 mm/sec towards a sheet discharge side as the dielectric belt 18 moves.

The sheet 5 having a toner image formed thereon is transported to the fixing section 11 by moving the dielectric belt 18. The sheet 5 having the toner image affixed thereon is discharged onto the discharge tray by the discharge roller, and is detected by the discharge sensor as properly discharged. Based on this detecting operation, the control section determines the completion of the normal printing operation. By the described image forming operation, a desirable image can be formed on the sheet 5.

The control electrode protection mechanism 32 for protecting the surface of the control electrode of the image forming apparatus of the present embodiment will be explained.

The image forming apparatus of the present invention is provided with the control electrode protection means which is moved interlocking with a rotating movement of the opening and closing member 17 so as to protect the surface of the control electrode 26 with an opening operation of the opening and closing member 17 which is integrally formed with the counter electrode 19 and is axially supported by the apparatus main body so as to be capable of opening and closing, while allowing the toner held on the toner holding member 22 to fly towards the counter electrode 19 with a closing operation of the opening and closing member 17.

Figure 1:
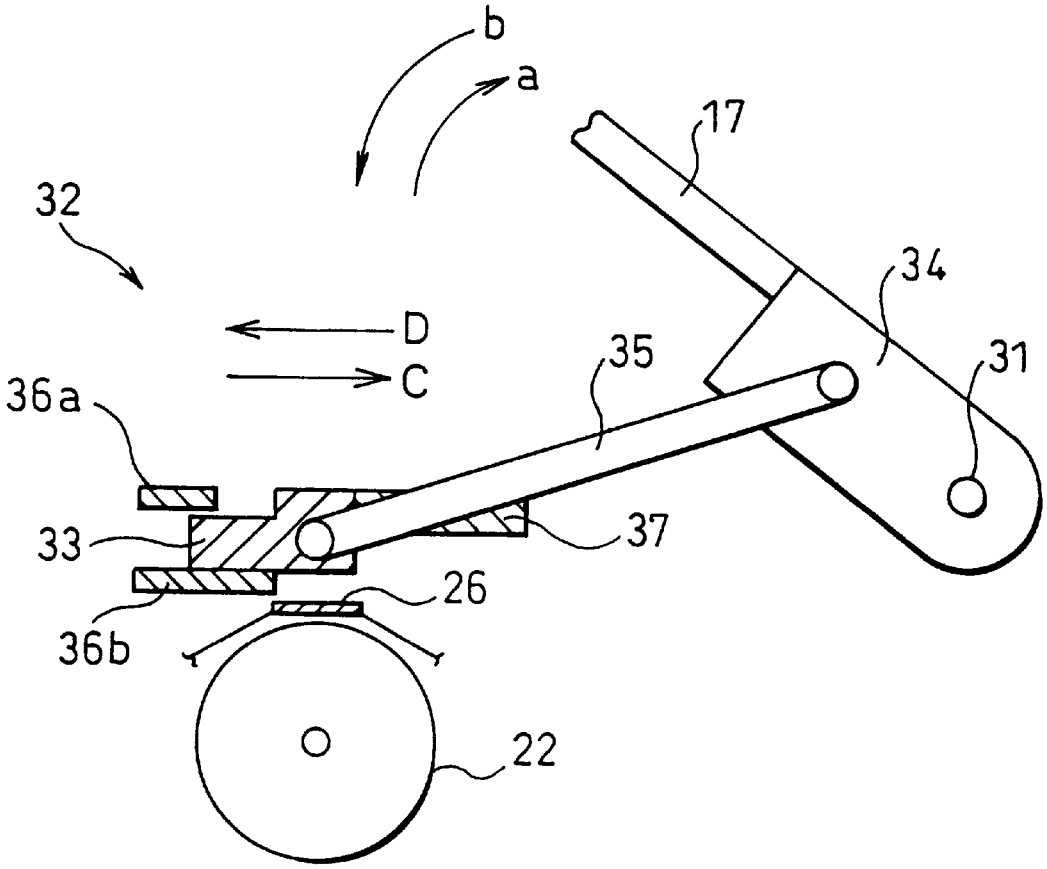
FIG. 1 is a cross-sectional view showing one example of control electrode protection means provided in an image forming apparatus in accordance with one embodiment of the present invention.

In the present embodiment, as shown in FIG. 1, the control electrode protection means is composed of a head cover 33 (slide member) which slides interlocking with a rotating movement of the opening and closing member 17 so as to open and close a portion above the control electrode 26. The head cover 33 is linked to the support member 34 for supporting the opening and closing member 17 by a linkage 35.

Interlocking with the rotary movement of the opening and closing member 17, the head cover 33 can slide in the horizontal direction as being guided by guides 36*b* and 36*a* formed in contact with the surface on the control electrode 26 side and the surface on the counter electrode side (see FIG. 2) of the head cover 33.

The described head cover 33 also serves as a paper guide (guide means) for guiding a transportation of the sheet 5 (see FIG. 2). As this eliminates a need of separately providing a guide for guiding the transportation of the sheet 5, the required number of components can be reduced, thereby reducing a cost of the apparatus. The guide 36*a* also serves as a paper guide (guide means).

Next, the operation of the protection mechanism of the control electrode 26 will be explained.

Figure 4:
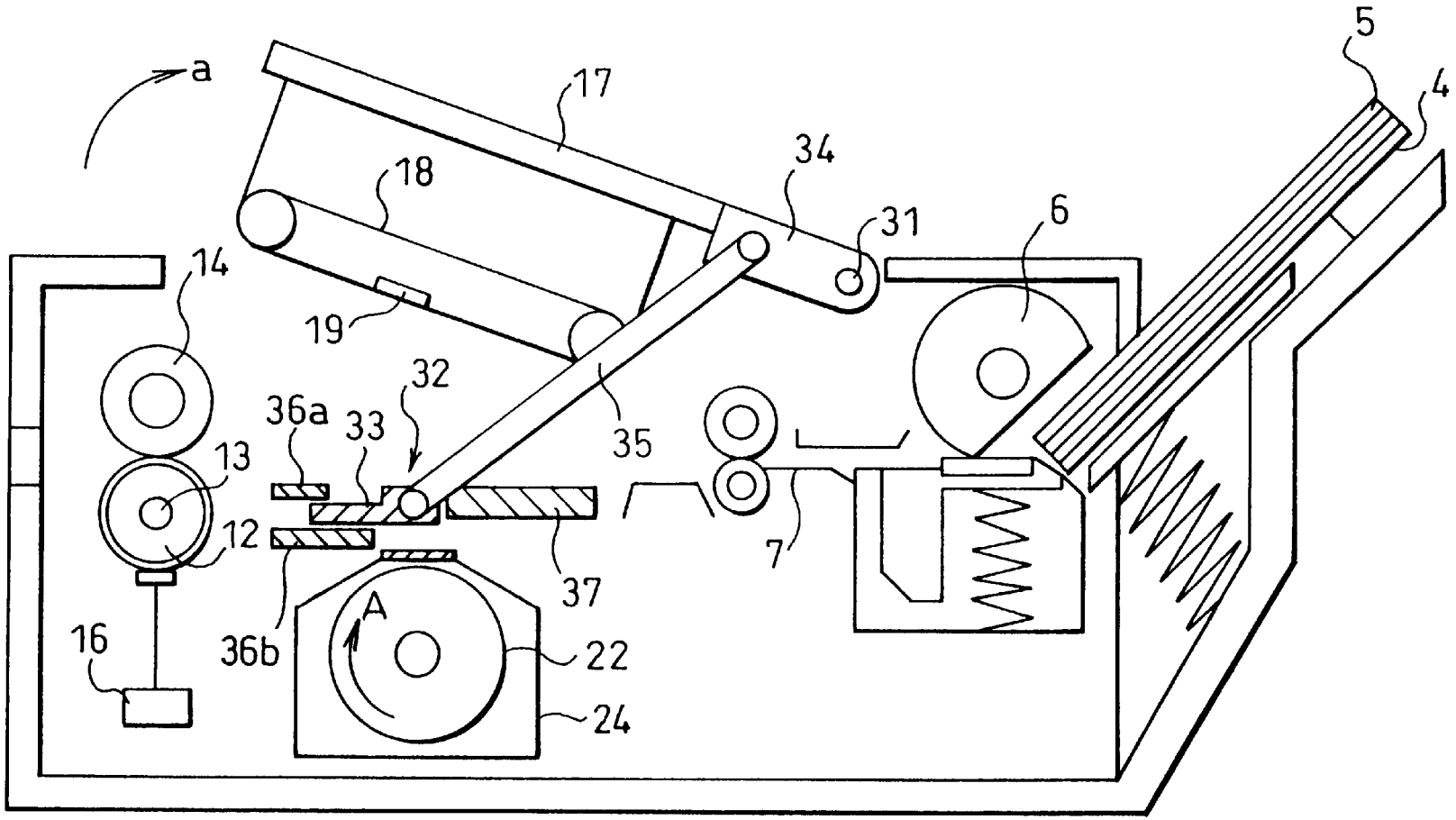
FIG. 4 is a cross-sectional view showing a state where the control electrode protection means is moved interlocking with an opening operation of the opening and closing member.
Figure 5A:
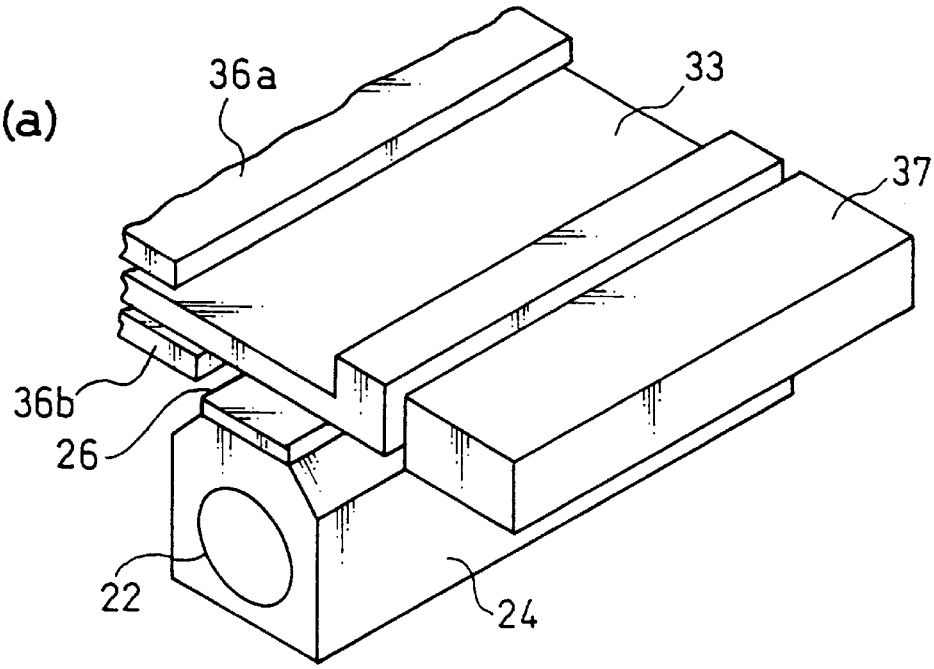
FIG. 5(*a*) is a perspective view showing a state where the control electrode protection means is moved so as to cover the upper surface of the control electrode interlocking with an opening operation of the opening and closing member.
Figure 5B:
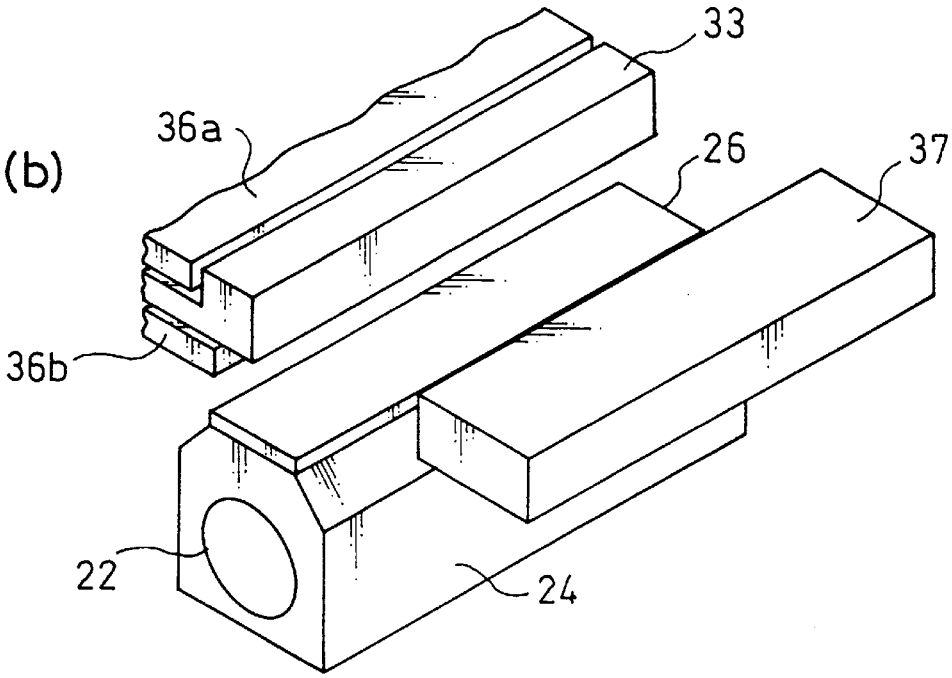

In order to remove a jammed sheet or exchange the toner cartridge, when depressing a button (not shown) for opening the opening and closing member 17, a stopper (not shown) is displaced, and the opening and closing member 17 rotates in a direction of an arrow a by a spring, etc., about a fulcrum 31 as shown in FIG. 1 and FIG. 4. Then, interlocking with the opening operation of the opening and closing member 17, the head cover 33 is horizontally moved in a direction of an arrow C as being guided by the guides 36*a* and 36*b*. Then, by making one end face of the head cover 33 contact the side face of the head cover 33 of the paper guide 37, the horizontal movement of the head cover 33 completes, and the opening section 38 (see FIG. 2) is closed. As a result, as shown in FIG. 5(*a*), the upper portion of the control electrode 26 is covered with the head cover 33.

When the removal of the jammed sheet, or the exchange of the toner cartridge is completed, and the opening and closing member 17 is closed as being pushed in a direction of an arrow b as shown in FIG. 1, the head cover 33 moves horizontally in a direction of an arrow D (see FIG. 1) interlocking with the closing operation of the opening and closing member 17. As a result, as shown in FIG. 5(*b*), the portion above the control electrode 26 is open, and the toner can fly from the toner holding member 22 towards the counter electrode 19 via the control electrode 26.

As described, when opening the opening and closing member 17, the head cover 33 is displaced so as to protect the surface of the control electrode 26 interlocking with the opening operation of the opening and closing member 17. Therefore, in order to remove a jammed sheet, exchange the toner cartridge, various checking with respect to a printing inferior, a finger of the operator or other member, etc., can be prevented from directly contacting the control electrode 26 as being exposed.

Therefore, when performing various maintenance operations, by making a contact with other member, the surface of the control electrode 26 can be prevented from soiling or being damaged. As a result, the flying of the developing material can be always controlled in a stable condition, thereby maintaining a desirable printing performance.

[EMBODIMENT 2]

Figure 6:
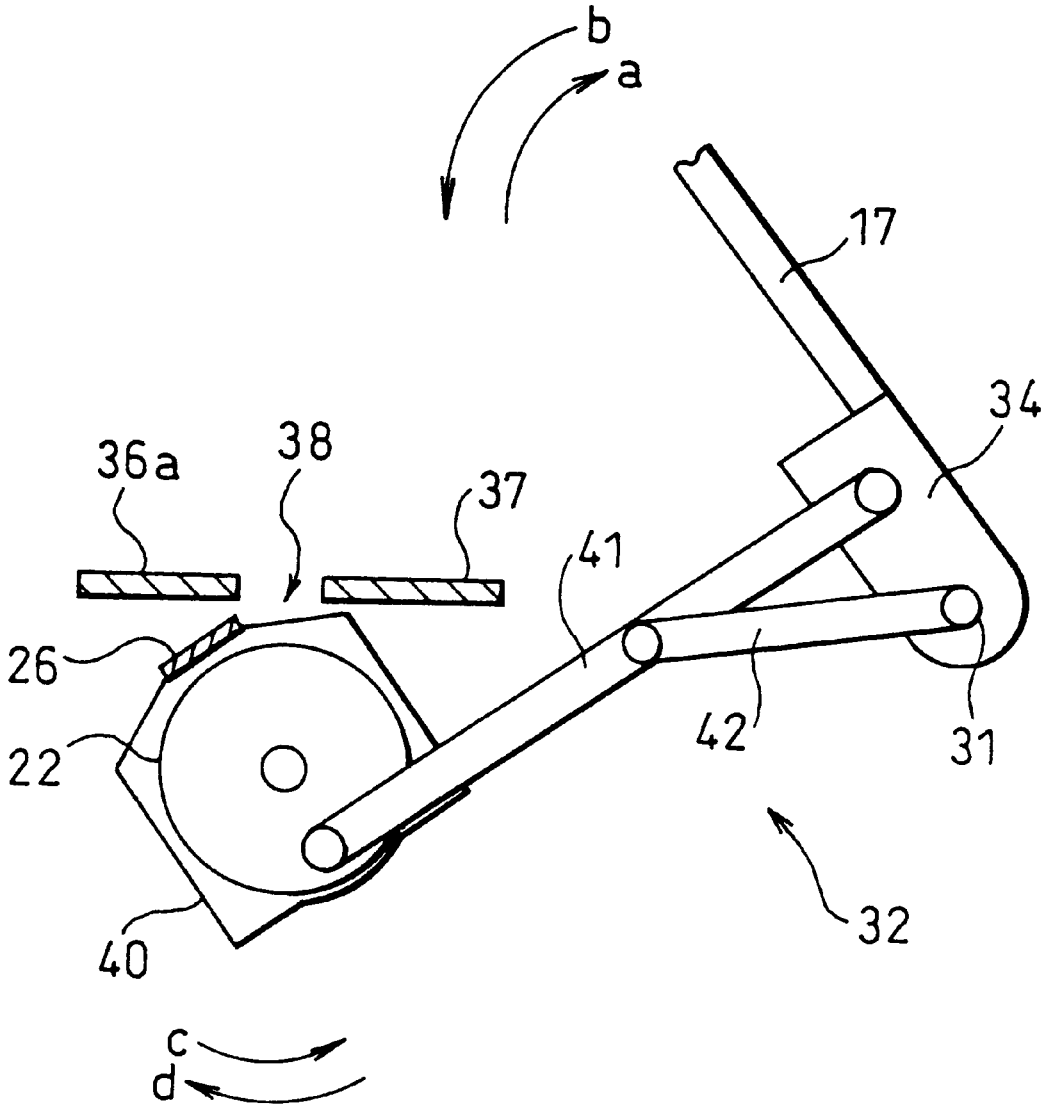
FIG. 6 is a cross sectional view showing a structure of the control electrode protection means in accordance with another embodiment of the present invention, showing the state where the control electrode protection means composed of a rotating member is rotated interlocking with an opening operation of the opening and closing member.

The following descriptions will explain another embodiment of the present invention in reference to FIG. 6. The arrangements of the present embodiment are the same those of the first embodiment except for a control electrode protecting mechanism 32. Therefore, members having the same functions as those of the aforementioned embodiment will be designated by the same reference numerals, and thus the descriptions thereof shall be omitted here.

As shown in FIG. 6, the control electrode protection means of the present embodiment is composed of a rotating member 40 wherein the toner holding member 22 and the control electrode 26 are integrated. The rotating member 40 is coaxially provided with the toner holding member 22 and is interlocked with a supporting member 34 for supporting an opening and closing member 17 by a linkage 41 (link mechanism). The control electrode protection means of the present embodiment includes the rotating member 40 and the link mechanism for rotating the rotating member 40 interlocking with the opening and closing operation of the opening and closing member. As a result, the rotating member 40 can rotate interlocking with a rotating operation of the opening and closing member 17.

The shaft 31 of the supporting member 34 and the linkage 41 are connected by a linkage 42. The control electrode 26 is mounted on the surface of the rotating member 40 at a position corresponding to a toner flying path before the rotating member 40 rotates.

In order to remove a jammed sheet or exchange the toner cartridge, when depressing a button for opening the opening and closing member 17, a stopper is displaced, and as shown in FIG. 6, the opening and closing member 17 rotates in a direction of an arrow a by, for example, springs, etc. Then, interlocking with the opening operation of the opening and closing member 17, the rotating member 40 rotates in a direction of an arrow c. Then, the control electrode 26 which is originally placed in the toner flying path is displaced from the path as the rotating member 40 rotates. Namely, when the opening and closing member 17 is open, the control electrode 26 is moved from the position below the opening section 38 formed between the guide 36*a* and the paper guide 37 to the position below the guide 36*a*. Consequently, the control electrode 26 is covered with the guide 36*a* (guide means, cover member).

On the other hand, upon completing a removal of a jammed sheet, or exchange of the toner cartridge, when the opening and closing member 17 is closed in a direction of an arrow b, the rotating member 40 starts rotating in a direction of an arrow d in the figure interlocking with the closing operation of the opening and closing member 17. Then, the control electrode 26 is moved from the position below the guide 36*a* to the position below the opening section 38 as the rotating member 40 rotates. Namely, the control electrode 26 as exposed is placed in the toner flying path, to allow the toner to fly from the toner holding member 22 towards the counter electrode 19 via the control electrode 26.

As described, in the present embodiment, when opening the opening and closing member 17, the control electrode 26 is moved with the rotation of the rotating member 40 from the position where the control electrode 26 is exposed. Therefore, the control electrode 26 can be prevented from having a direct contact with other member when carrying out various checking. As this prevents the surface of the control electrode 26 from soiling or being damaged, a flying of the toner can be controlled always under stable conditions, thereby maintaining desirable printing performances.

According to the described arrangement, even in the case where there is not enough space above the control electrode 26, and the head cover 33 (see FIG. 1) is difficult to be formed so as to cover the control electrode 26 like the arrangement of the first embodiment, by providing the described rotating member 40, the surface of the control electrode 26 can be protected. As this offers a simpler structure than the case of adopting the head cover 33, the size of the apparatus can be made reduced.

[EMBODIMENT 3]

Figure 7:
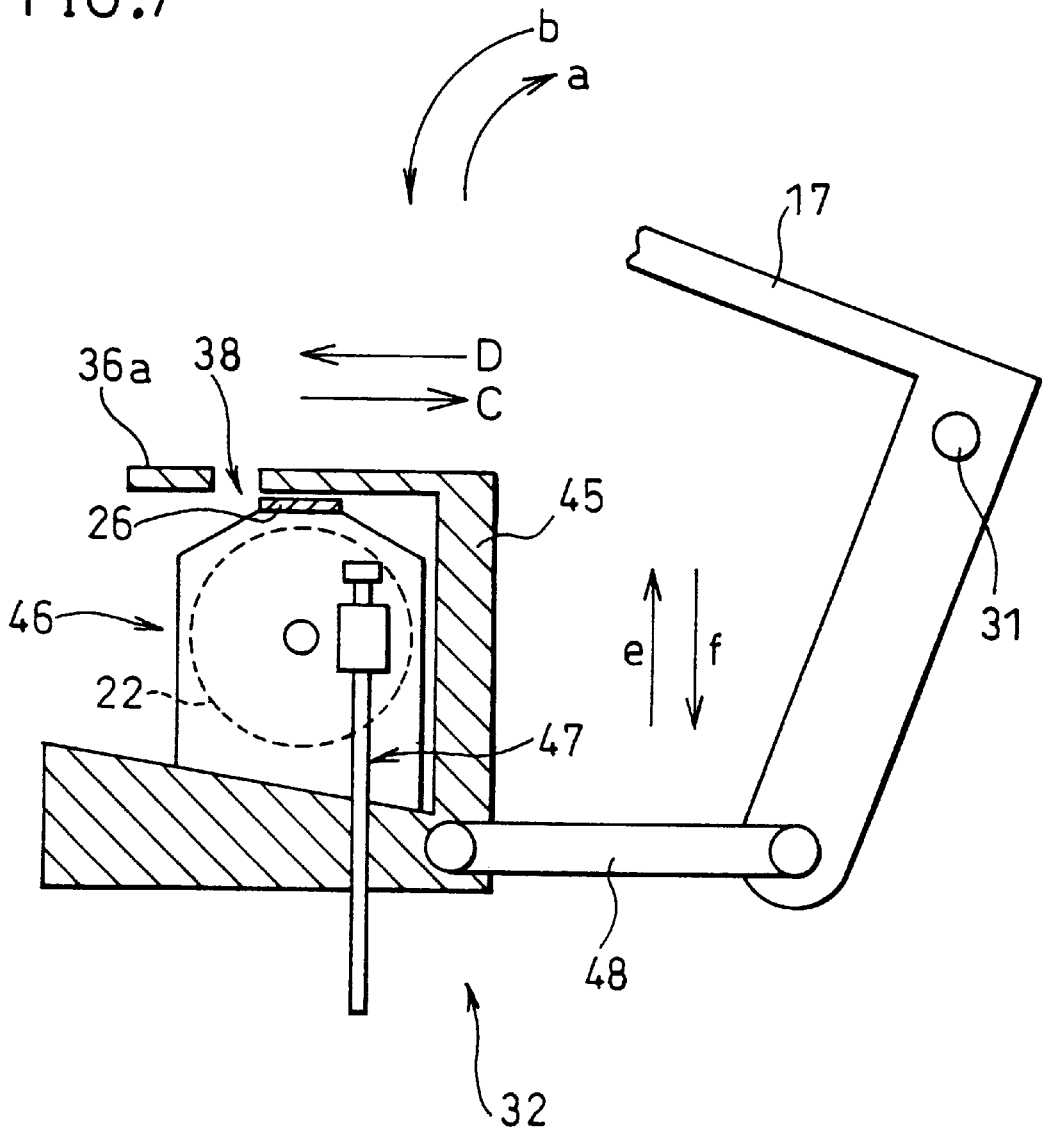
FIG. 7 is a cross sectional view showing a structure of the control electrode protection means in accordance with still another embodiment of the present invention, showing the state where the control electrode protection means is moved so as to cover the upper surface of the control electrode interlocking with an opening operation of the opening and closing member.
Figure 8:
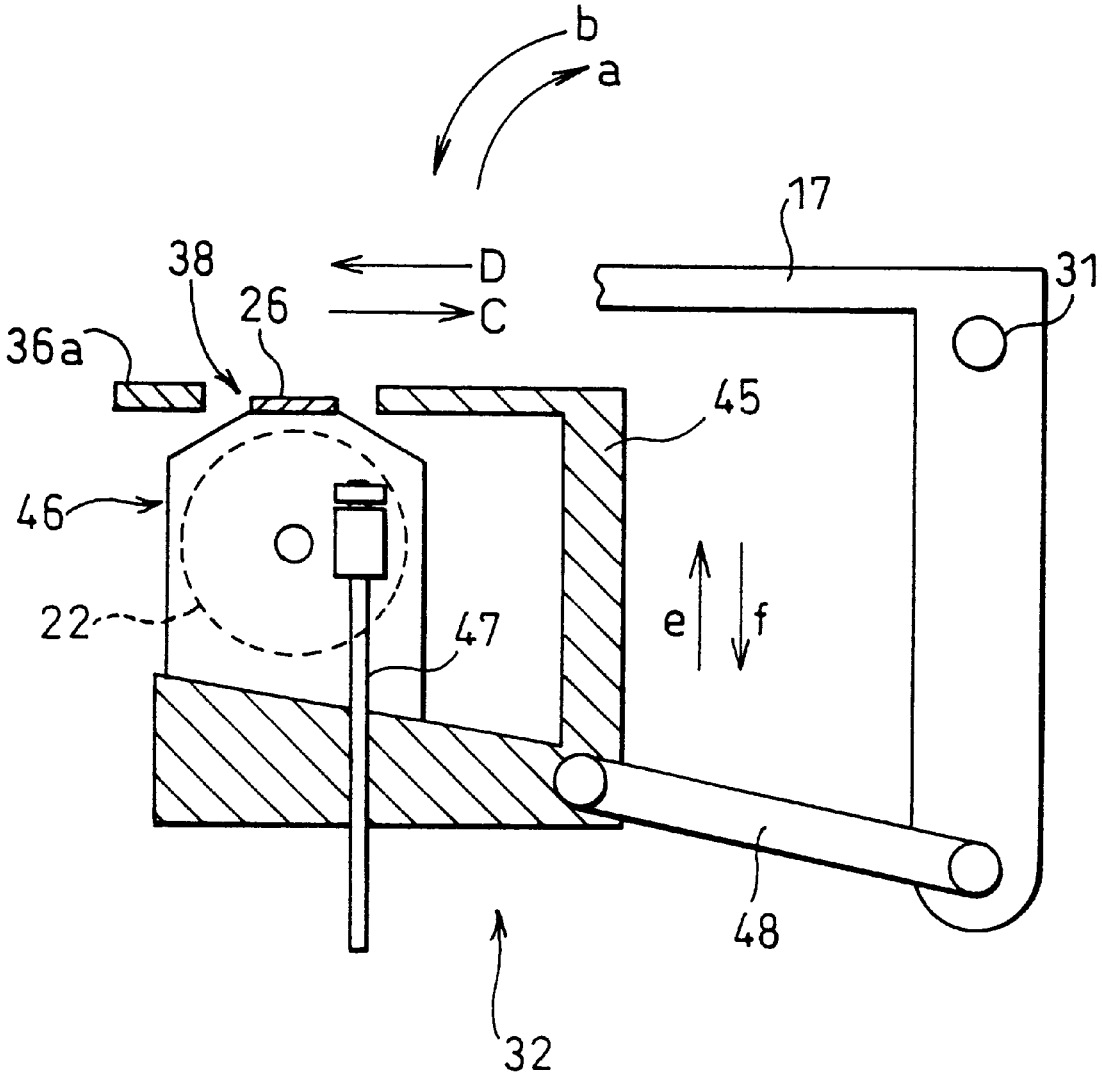
FIG. 8 is a cross-sectional view showing the state where the control electrode protection means is moved so as to open the upper surface of the control electrode interlocking with a closing operation of the opening and closing member.

The following descriptions will explain still another embodiment of the present invention in reference to FIG. 7 and FIG. 8. The present embodiment, explanations on another arrangement of the control electrode protecting mechanism 32 in the arrangement of the first embodiment. For convenience in explanations, members having the same functions as those of the aforementioned embodiment will be designated by the same reference numerals, and thus the descriptions thereof shall be omitted here.

The control electrode protection means of the present embodiment includes a head cover 45 (protecting member) having a cross section substantially in a "°" shape which moves in a horizontal direction to achieve a slide movement of a printing unit 46 in which the toner holding member 22 and the control electrode 26 are integrated in a vertical direction and protects the control electrode 26. The printing unit 46 is placed on a sloped surface (placement surface) formed inside (placement section) of the head cover 45. The head cover 45 is connected to the opening and closing member 17 by a linkage 48. The opening and closing member 17 is axially supported to the apparatus main body to be rotatable about the shaft 31. When opening the opening and closing member 17, the head cover 45 is horizontally moved in a direction of an arrow D so as to cover over the control electrode 26, and generates the downward (in a direction of an arrow f) movement of the printing unit 46 as being guided by the guide 47 (guide means). On the other hand, when closing the opening and closing member 17, the control electrode 26 is horizontally moved in a direction of an arrow C to open the position above the control electrode 26, and generates an upwards sliding movement (in a direction of an arrow e in the figure) of the printing unit 46 as being guided by the guide 47. Namely, the head cover 45 and the printing unit 46 are moved in mutually different directions.

Additionally, the head cover 45 serves as a paper guide for guiding the transportation of the sheet 5 (see FIG. 2). As this eliminates a need of separately providing a guide for guiding the transportation of the sheet 5, a required number of components can be reduced to lower the cost of the apparatus.

In order to remove a jammed sheet or exchange the toner cartridge, when depressing a button for opening the opening and closing member 17, a stopper is displaced, and as shown in FIG. 7, the opening and closing member 17 rotates in a direction of an arrow a, for example, by springs. Then, interlocking with the opening operation of the opening and closing member 17, the linkage 48 pushes the head cover 45 in a direction of an arrow D in the figure.

Here, as the placement surface where the printing unit 46 is placed is sloped, with the sliding movement of the head cover 45 in the above direction, the printing unit 46 is guided by the guide 47 downwards (in a direction of an arrow f), and the portion above the control electrode 26 of the printing unit 46 is covered with the head cover 45.

On the other hand, upon completing a removal of the jammed sheet or an exchange of the toner cartridge, by closing the opening and closing member 17 in a direction of an arrow b, by pressing it as shown in FIG. 8, the linkage 48 pulls the head cover 45 in a direction of an arrow C interlocking with the closing operation of the opening and closing member 17.

Then, with the sliding movement of the head cover 45 in the above direction, an opening section 38 is formed between the guide 36*a* and the head cover 45, and along the slope of the head cover placing surface, the printing unit 46 is pushed to slide upwards (in a direction of an arrow e) by the guide 47. As a result, the control electrode 26 is moved to a vicinity of the opening section 38.

As described, when opening the opening and closing member 17, the head cover 45 is moved so as to cover the portion above the control electrode 26. Thus, when opening the opening and closing member 17, the control electrode 26 can be prevented from having other member directly contact thereon. As this prevents the surface of the control electrode 26 from soiling or being damaged when carrying out various maintenance processes, a flying of toner can be controlled always under stable conditions, thereby maintaining desirable printing performances.

Additionally, as the surface inside of the head cover 45 for placing thereon the printing unit 46 is sloped, as the head cover 45 is moved interlocking with the rotating operating of the opening and closing member 17, the printing unit 46 is moved to slide in a vertical direction. Therefore, the described arrangement is effective for the case where a distance between the control electrode 26 and the counter electrode 19 is small, and even in such case, the surface of the control electrode 26 can be protected for sure.

The head cover 33 adopted in the first embodiment and the head cover 45 adopted in the present embodiment are composed of, for example, an insulating member. In order to clarify the effects of an electrical resistivity of the insulating member on an image quality, experiments are conducted by varying an electrical resistivity of the insulating member under various conditions (i) high temperature and high humidity, (ii) normal temperature and normal humidity and (iii) low temperature and low humidity by varying an electrical resistivity of the insulating member. Here, high temperature and high humidity indicates a range of from 30° C., 80% RH (Relative Humidity) to 35° C., 60% RH. The results of the experiments are summarized in Table 1.

TABLE 1

| Electrical Resistivity | $10^6$ | $10^7$ | $10^8$ | $10^9$ | $10^{10}$ | $10^{11}$ | $10^{12}$ |
|---|---|---|---|---|---|---|---|
| High Tem. and High Hum. | D | D | C | B | A | A | A |
| Normal Tem. and Normal Hum. | A | A | A | B | C | D | D |
| Low Tem. and Low Hum. | A | A | B | C | D | D | D |

In Table 1: A: excellent, B: good, C: fair, and D: inferior.

As is clear from the results shown in Table 1, under the conditions of high temperature and high humidity, a desirable image quality can be achieved when an electrical resistivity of the insulating member is not less than $10^{10}$ Ω·cm. The above results are achieved for the reason that the resistivity of the head cover 33 or 45 becomes high, and a voltage to be applied to the control electrode 26, etc., can be prevented from being leaked to the head cover 33 or 45. Under the described conditions, when the electrical resistivity of the insulating member is not less than $10^8$Ω·cm, preferable not less than $10^9$Ω·cm, at least an image can be prevented from being disturbed when printing.

On the other hand, under the condition of normal temperature and normal humidity, as long as the electrical resistivity of the insulating member is not more than $10^8$Ω·cm, a desirable image quality can be achieved. This is because a generation of a static electricity generated by a friction with a sheet can be prevented. Under the described conditions, as long as the electrical resistivity of the insulating member is not more than $10^{10}$Ω·cm, preferably not more than $10^9$Ω·cm, at least an image can be prevented from being disturbed when printing.

From the results of the above experiments, in the case where the head cover 33 or 45 serves also as a paper guide for guiding a transportation of the sheet 5 (see FIG. 2), it is preferable to adopt a material having an electric resistivity of not more than $10^8$Ω·cm under the condition of normal temperature and normal humidity for the head cover 33 or 45. Additionally, in the case where the head cover 33 or 45 is located in a vicinity of the control electrode 26 in the state where the image forming operation is permitted, it is preferable to adopt a material having an electric resistivity of not less than $10^{10}$Ω·cm under the condition of high temperature and high humidity (in a range of from 30° C., 80% RH to 35° C. 60% RH). By selecting the material based on the above, the described problems can be avoided, thereby maintaining desirable printing performances even under unpreferable conditions.

[EMBODIMENT 4]

The following descriptions will explain still another embodiment of the present invention in reference to FIG. 9 through FIG. 14. For convenience in explanations, members having the same functions as those of the aforementioned embodiment will be designated by the same reference numerals, and thus the descriptions thereof shall be omitted here.

Figure 9:
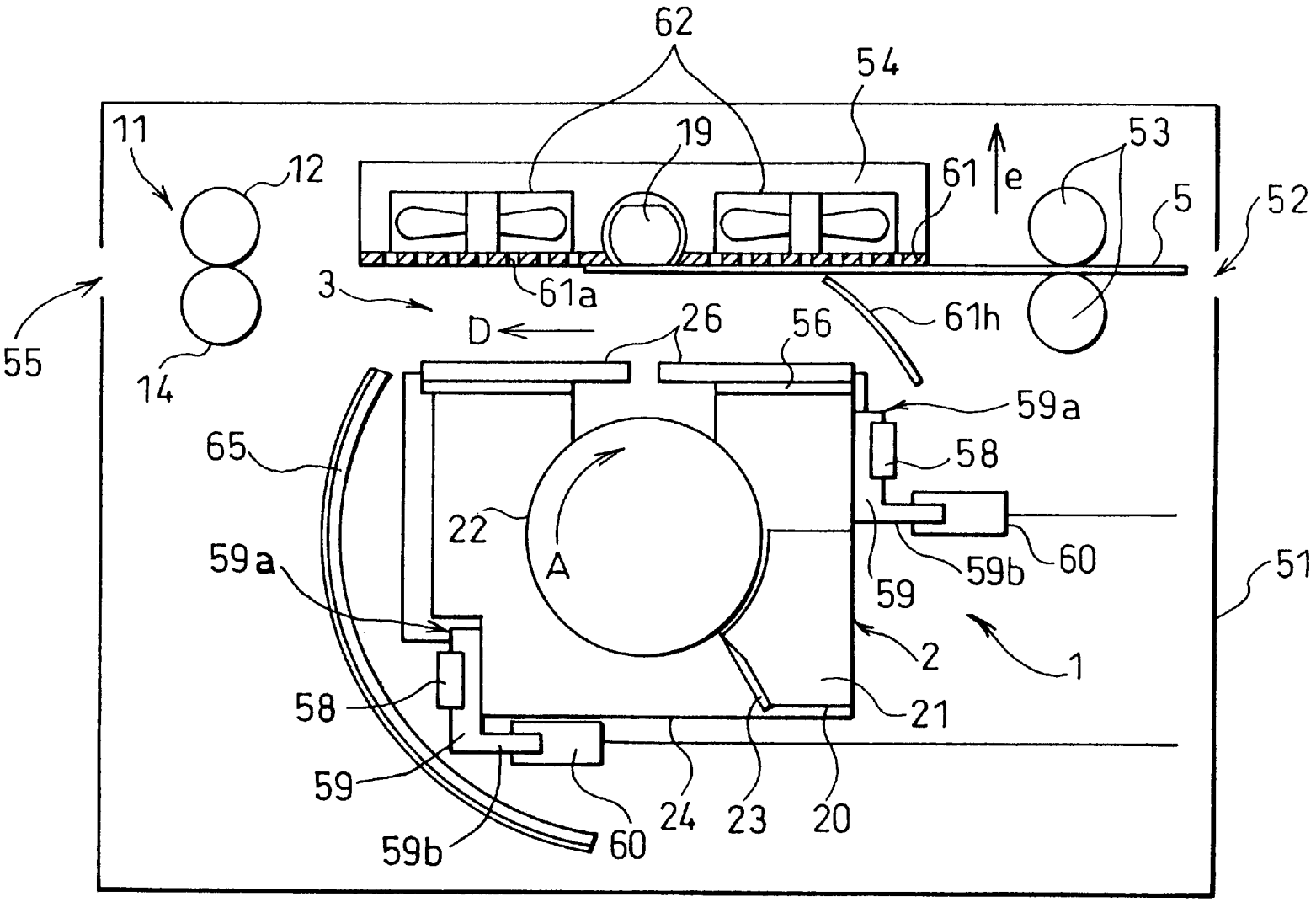
FIG. 9 is a cross-sectional view showing a schematic structure of an image forming apparatus in accordance with yet still another embodiment of the present invention.

As shown in FIG. 9, an image forming apparatus in accordance with the present embodiment includes an image forming section 1 having a tonner supply section 2 and a printing section 3. On one side surface of a cabinet 51 of an apparatus main body, formed is a sheet entry opening 52 for supplying a sheet 5 to the image forming section 1, and the sheet 5 as supplied through the sheet entry opening 52 is directed to a transporting member 54 (to be described later) by a pair of guide rollers 53.

At a discharging position where the sheet 5 is discharged from the image forming section 1, formed is a fixing section 11 including at least a heat roller 12 and a pressure roller 14, and a toner image formed on the sheet 5 by the image forming section 1 is made permanently affixed thereon by the fixing section 11. The sheet 5 having the toner image affixed by the fixing section 11 is discharged outside of the apparatus main body through the sheet discharge opening 55.

On the other hand, the toner supply section 2 of the image forming section 1 includes a toner storage vessel 20 for storing a toner 21, a toner holding member 22 of a cylindrical sleeve for holding the toner 21 using a magnetic force, a doctor blade 23 for charging the toner 21 and regulating a thickness of a toner layer to be held on a peripheral surface of the toner holding member 22, a control electrode 26 provided in a toner flying path between the toner holding member 22 and the counter electrode 19 (to be described later), and a control electrode protecting member 65 (control electrode protection means, shutter). The control electrode protecting member 65 will be described in detail later. In the present embodiment, a toner holding member storage vessel 24 is constituted by a cartridge ASSY (Assembly) (opening and closing mechanism, unit) wherein the toner storage vessel 20 and a control electrode base 56 for placing thereon the control electrode 26 are incorporated. This toner holding member storage vessel 24 functions as an opening and closing mechanism capable of opening and closing the inside of the apparatus main body. The toner holding member storage vessel 24 is mounted to the apparatus main body in such a manner that installation and removal thereof are permitted. Here, the toner storage vessel 20, the toner 21, the doctor blade 23 and the control electrode base 56 are the same as those adopted in the first through third embodiments.

To the toner holding member storage vessel 24 mounted is a high voltage driver holding member 59 for holding a high voltage driver 58 for applying a voltage to the control electrode 26. The high voltage driver 58 is held by the high voltage driver holding member 59 in such a manner that it can be exchanged immediately when necessary, for example, in an event of some trouble.

The input section 59*a* for the control electrode 26 and the high voltage driver 58 are electrically connected, and the high voltage driver 58 and a connector section 59*b* for the high voltage driver holding member are also electrically connected. Therefore, when installing the cartridge ASSY into the apparatus main body, the connector section 59*b* is connected to a connector 60 of the apparatus main body which is electrically connected to a control power supply section (not shown). As a result, the control electrode 26 and the control power supply section are electrically connected.

The printing section 3 of the image forming section 1 includes the transporting member 54. The transporting member 54 includes a counter electrode 19 opposing a peripheral surface of the toner holding member 22, a high pressure power supply (not shown) for supplying a high pressure to the counter electrode 19, a sheet transport guide 61 and a fans 62. The sheet transport guide 61 has a plurality of holes 61*a* formed on the side of a sheet transport surface, and the sheet 5 is attracted in a direction of an arrow e by the rotations of the fans 62.

According to the described arrangement, when the sheet 5 is supplied through the sheet entry opening 52, the sheet 5 is transported in a direction of an arrow D by the pair of guide rollers 53. Then, the sheet 5 is guided by an edge 65*h* of support pieces 61*a* and 65*b* of a control electrode protecting member 65 (to be described later) to the sheet transport guide 61 of the transporting member 54, and the sheet 5 is attracted to the sheet transport guide 61 by rotating the fans 62.

Then, after the toner image is formed on the sheet 5 by the image forming section 1 in the same manner as the aforementioned embodiment 1, the sheet 5 is transported to the fixing section 11 by the rotations of the guide roller 53, and the toner image is fixed onto the sheet 5 by the fixing roller 11. The sheet 5 having the toner image permanently affixed thereon is discharged to the outside of the apparatus main body through a sheet discharge opening 55 only by rotating the heat roller 12 and the pressure roller 14.

Figure 10:
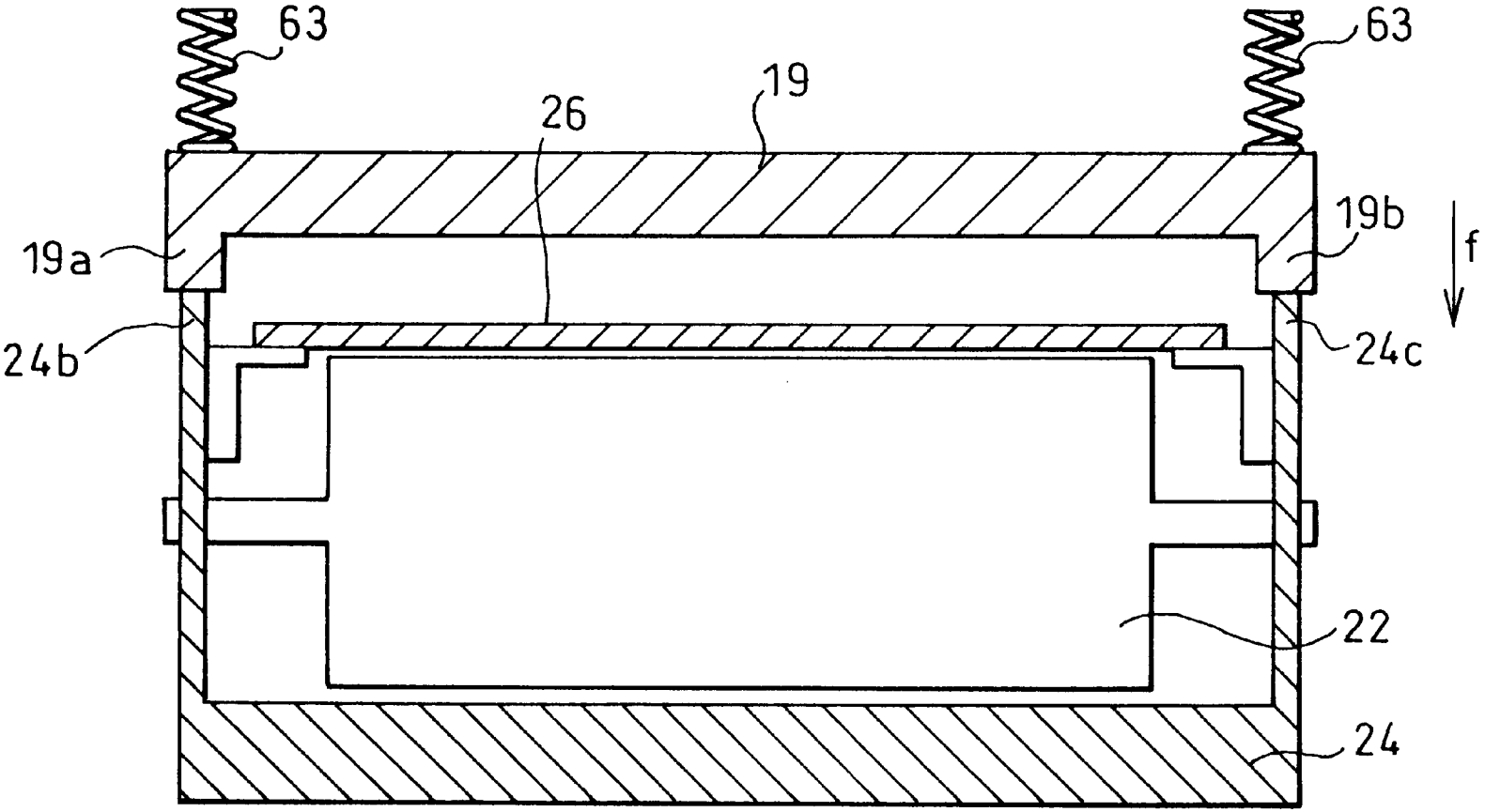
FIG. 10 is a cross-sectional view showing the state where the counter electrode is pushed towards a holding member storage vessel by pushing means.

In the image forming apparatus of the present embodiment, as shown in FIG. 10, the counter electrode 19 is always pushed in a direction of an arrow f by counter electrode springs 63 (pushing means) formed on the upper surface of the transporting member 54 (see FIG. 9) . The counter electrode 19 has projecting pieces 19*a* and 19*b* (spacer) formed at such positions that the transportation of the sheet 5 is not affected. The projecting pieces 19*a* and 19*b* of the counter electrode 19 always contact contacting pieces 24*b* and 24*c* of the toner holding member storage vessel 24.

According to the described arrangement, even when exchanging, for example, the counter electrode 19, the toner holding member storage vessel 24, and an interval between the toner holding member 22 and the counter electrode 19 is difficult to deviate, and variations in the interval can be reduced to the minimum. Therefore, a desirable image forming process can be surely performed without affecting the image forming process due to variations in the interval.

Figure 11:
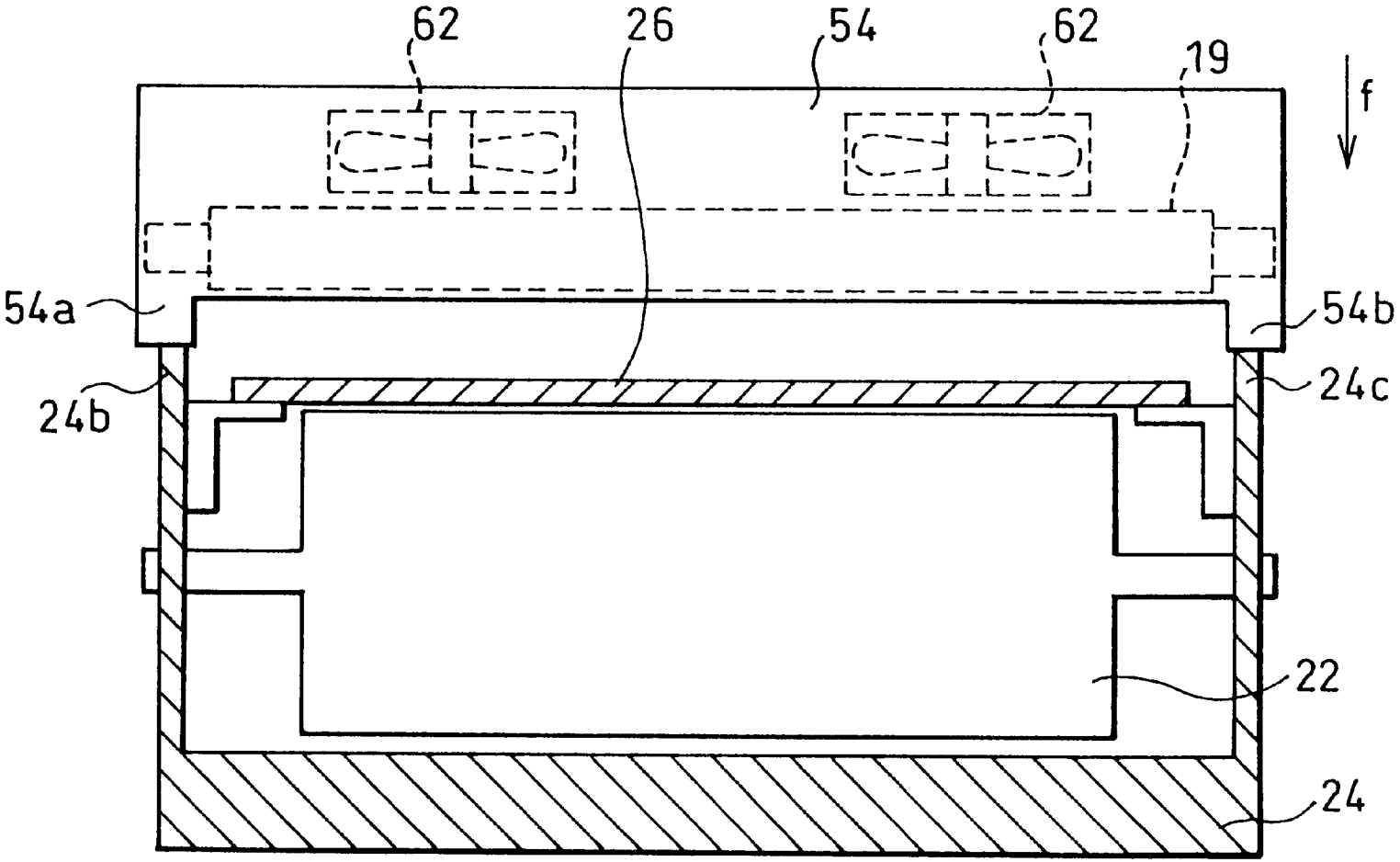
FIG. 11 is a cross-sectional view showing the state where a transporting member having the counter electrode is pushed towards a holding member storage vessel by pushing means.

As shown in FIG. 11, it may be arranged such that the transporting member 54 having the counter electrode 19 mounted thereon is pushed in a direction of an arrow f by springs (pushing means) not shown. In this state, projections 54*a* and 54*b* of the transporting member 54 formed at such positions that the transportation of the sheet 5 is not disturbed always contact the contacting pieces 24*b* and 24*c* of the toner holding member storage vessel 24 respectively, a deviation in an interval between the toner holding member 22 and the counter electrode 19 can be reduced to the minimum. Therefore, a desirable image forming process can be surely performed without affecting the image forming process due to variations in the interval like the aforementioned arrangement.

The following descriptions will explain the control electrode protecting member 65 provided in the image forming apparatus of the present embodiment.

As shown in FIG. 9 through FIG. 12, the image forming apparatus of the present embodiment includes the control electrode protecting member 65 which is moved interlocking with installation and removal movements of the toner holding member storage vessel 24 with respect to the apparatus main body. Specifically, the control electrode protecting member 65 protects the surface of the control electrode 26 when the toner holding member storage vessel 24 is removed from the apparatus main body, and is moved to allow the toner 21 held on the toner holding member 22 to fly towards the counter electrode 19 via the control electrode 26 when the toner holding member storage vessel 24 is installed in the apparatus main body.

Figure 13:
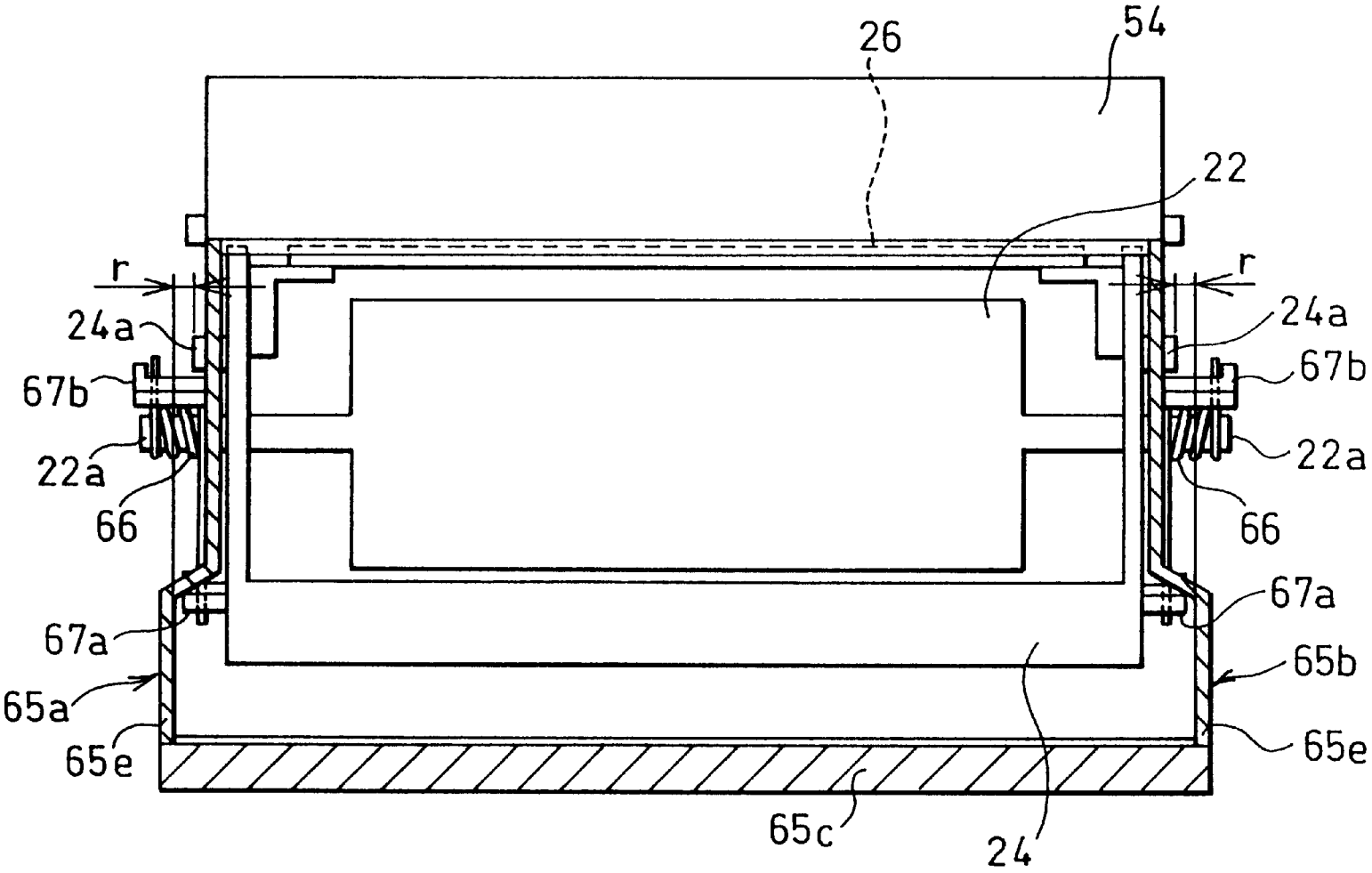
FIG. 13 is a cross-sectional view showing the state where the control electrode protection means is moved so as to allow a developing material to fly from the holding member towards the counter electrode interlocking with an installing operation of the holding member storage vessel to an apparatus main body.
Figure 14:
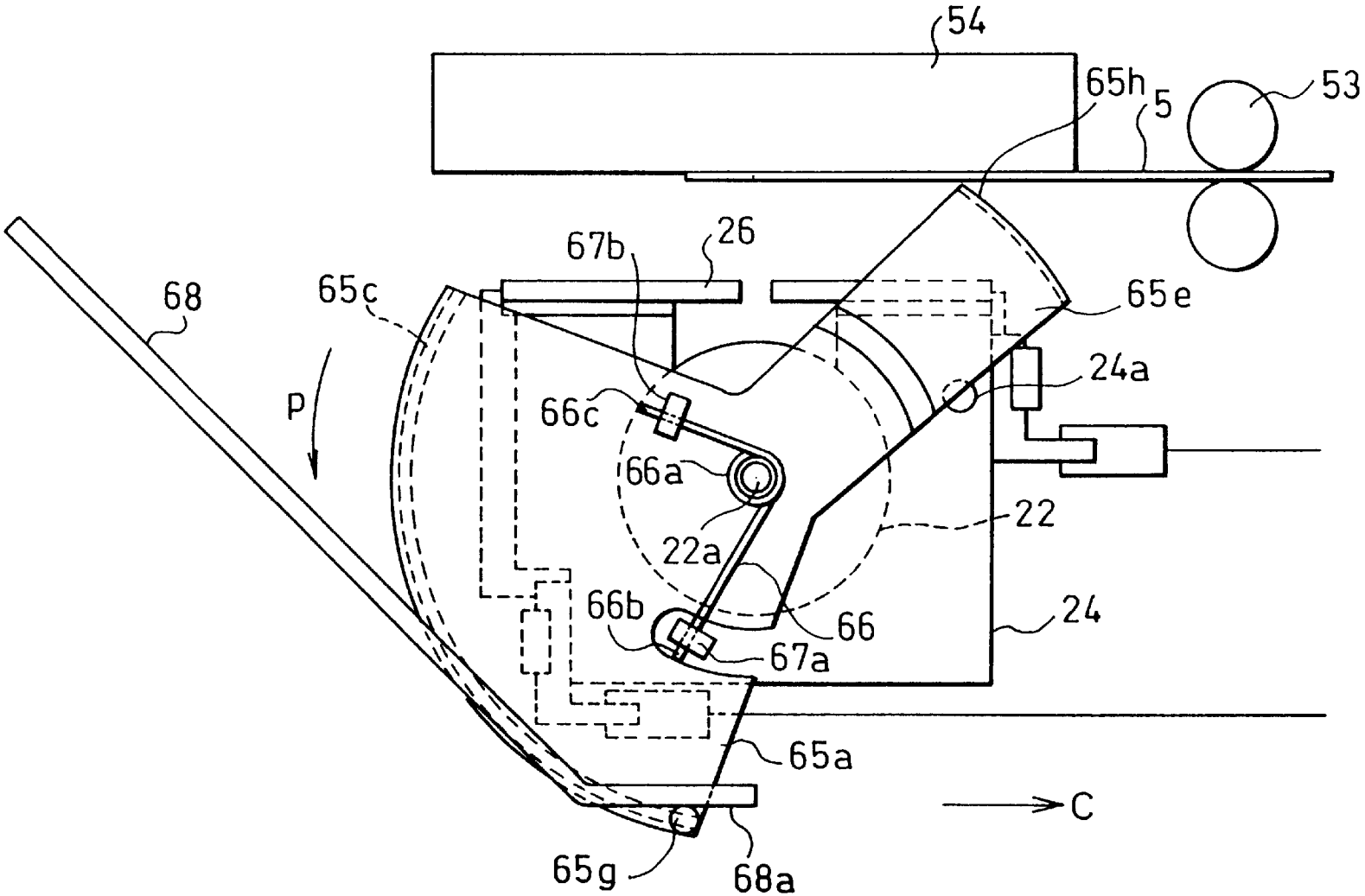
FIG. 14 is a side view showing the state where the control electrode protection means is moved so as to allow the developing material to fly from the holding member towards the counter electrode.

The control electrode protecting member 65 is structured such that a protection cover 65*c* having an arc cross section is formed between two supporting pieces 65*a* and 65*b* (see FIG. 13 and FIG. 14). The protecting cover 65*c* is made of an impact absorbing member such as a foaming material to prevent the control electrode 26 from scratching due to a contact with an external section 26.

The control electrode protecting member 65 is mounted to the toner holding member storage vessel 24 coaxially with the toner holding member 22. Namely, the toner holding member storage vessel 24 rotates about the rotation shaft 22*a* of the toner holding member 22. In the rotation shaft 22*a*, the coil section 66*a* of the spring 66 is inserted, while one end portion 66*b* of the spring 66 is held on the toner holding member storage vessel 24 by the stopper 57*a*, while the other end portion 66*c* of the spring 66 is held by the stoppers 67*a* and 67*b*.

Figure 12:
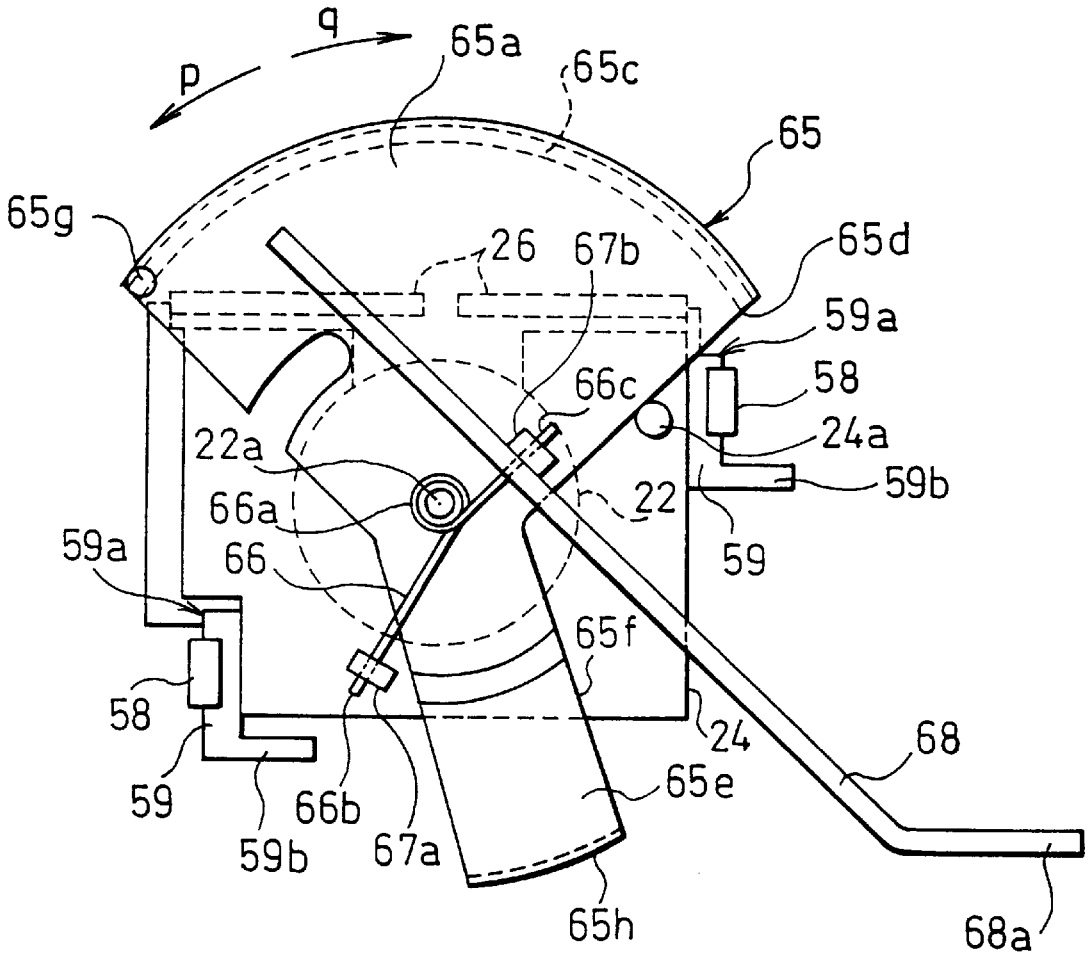
FIG. 12 is a side view showing the state where control electrode protection means is moved so as to protect the control electrode interlocking with a removing operation of the holding member storage vessel from an apparatus main body.

Additionally, the spring 66 is always stopped by the stoppers 67*a* and 67*b* so that a force is always exerted in a direction of an arrow q (see FIG. 12). Therefore, the control electrode protecting member 65 is also always pushed in the above direction.

The projection 24*a* is formed in the toner holding member storage vessel 24, and when the toner holding member supporting vessel 24 is not mounted to the apparatus main body, the edge 65*d* of the supporting pieces 65*a* and 65*b* contact the projection 24*a*.

A part of the supporting pieces 65*a* and 65*b* are formed by a bent piece 65*e*, and as shown in FIG. 13, a clearance r is formed between the projection 24*a* and the bent piece 65*e*. As a result, when rotating the control electrode protecting member 65, the edge 65*d* of the supporting pieces 65*a* and 65*b* can contact the projection 24*a*, but the edge 65*f* of the bent piece 65*e* does not contact the projection 24*a*. Therefore, the projection 24*a* does not interfere the supporting pieces 65*a* and 65*b* other than contacting the edge 65*d*.

On the supporting pieces 65*a* and 65*b*, a projection 65*g* which can contact a rib 68 mounted to the apparatus main body. When horizontally moving the toner holding member storage vessel 24 in a direction of an arrow C in FIG. 14, the projection 65*g* contacts a rib 68, which, in turn, rotates the control electrode protecting member 65 in a direction of an arrow p in the figure.

Next, the operation of the control electrode protecting member 65 will be explained in detail.

As shown in FIG. 12, when the toner holding member storage vessel 24 is not installed in the apparatus main body, as a force of the spring 66 in a direction of an arrow q, the edge 65*d* of the supporting pieces 65*a* and 65*b* maintain the contact state with the projection 24*a*. In this state, the control electrode 26 is covered with the protecting cover 65*c*.

On the other hand, when mounting the toner holding member supporting vessel 24 to the apparatus main body, by sliding the toner holding member storage vessel 24 in a direction of an arrow C as shown in FIG. 14, the projection 65*g* of the control electrode protecting member 65 contacts the rib 68 mounted to the apparatus main body. Then, by further sliding the toner holding member storage vessel 24 in the above direction, the control electrode protecting member 65 rotates in a direction of an arrow q while the projection 65*g* contacting the rib 68.

Then, the projection 65*g* contacts the end portion 68*a* of the rib 68, and as shown in FIG. 9, the connector section 59*b* (second connector) mounted to the toner holding member storage vessel 24 mates with the connector 60 (first connector) of the apparatus main body to complete the installation of the toner holding member storage vessel 24 into the apparatus main body.

As a result, as shown in FIG. 14, the portion above the control electrode 26 which has been covered with the protecting cover 65*c* becomes open, to, allow the toner 21 to fly towards the counter electrode 19 via the control electrode 26 from the toner holding member 22. Then, the edge 65*h* of the bent piece 65*e* in a vicinity of the transport member 54 serves as the guide member for guiding the transportation of the sheet 5.

As described, when removing the toner holding member storage vessel 24 from the apparatus main body, the control electrode protecting member 65 is displaced so as to protect the surface of the control electrode 26 interlocking with the described removal operation, thereby preventing the control electrode 26 which would be exposed otherwise from contacting the finger of the operator or other members.

Therefore, according to the described arrangement, the surface of the control electrode 26 can be prevented from soiling or scarred due to a contact with other members during maintenance operations of various members. As a result, the flying of toner can be stably controlled, thereby maintaining desirable printing operations.

When installing the toner holding member storage vessel 24 in the apparatus main body, the edge 65*h* of the bent piece 65*e* of the control electrode protecting section 65 serves as a guide member (guide means) for guiding the transportation of the sheet 5, which eliminates a need of separately providing a guide member for transporting the sheet 5. As this permits the number of components as required to be reduced, a manufacturing cost of the apparatus can be reduced.

Moreover, the toner holding member supporting vessel 24 has the connector section 59*b* for the high voltage driver which is electrically connected to the control electrode 26 and can mate with the connector 60 on the apparatus main body. Therefore, by connecting the connector 60 with the connecting section 59*b*, the toner holding member storage vessel 24 is stably fixed to the apparatus main body. Therefore, with the described simple structure, the toner holding member storage vessel 24 can be always fixed under stable conditions, and respective exchange operations of the control electrode 26 and the toner holding member 22 can be performed with ease.

The first image forming apparatus in accordance with the present invention is characterized by comprising: a holding member for holding a developing material; a counter electrode placed opposing the holding member; a control electrode for controlling a flying of the developing material by varying an electric field between the holding member and the counter electrode; and control electrode protection means for protecting a surface of the control electrode in an open state of an opening and closing member which is integrally formed with the counter electrode and permitting the developing material held on the holding member to fly towards the counter electrode in a closed state of the opening and closing member by moving interlocking with rotating operations of the opening and closing member, the control electrode protection means being axially supported so as to be capable of opening and closing with respect to the apparatus main body.

According to the described arrangement, as the electric field between the toner holding member and the counter electrode varies by the control electrode, a flying of the developing material from the toner holding member to the counter electrode is controlled. Here, when opening the opening and closing member which is integrally formed with the counter electrode, the control electrode protection means moves so as to protect the surface of the control electrode interlocking with the opening operation. According to the described arrangement, for example, when the opening and closing member is open to remove a jammed sheet, exchange the toner cartridge, or to perform various checking for the printing inferior, the control electrode which would be exposed otherwise can be prevented from having a direct contact with a finger of an operator, other member of the apparatus, etc.

On the other hand, when closing the opening and closing member, the control electrode protection means is moved interlocking with the closing operation of the opening and closing member so as to allow the control electrode to control the flying of the developing material. As this permits the developing material to fly without being disturbed by the control electrode protection means, a normal image forming operation can be performed.

Therefore, according to the arrangement of the present invention, the surface of the control electrode can be prevented from soiling or being damaged by a contact with other members when carrying out various maintenance operations. As a result, the flying of the developing material can be always controlled under stable conditions, thereby maintaining a desirable printing performance.

The second image forming apparatus in accordance with the present invention having the arrangement of the first image forming apparatus is characterized in that the control electrode protection means is made of a slide member for sliding so as to open and close a portion above the control electrode interlocking with rotating operations of the opening and closing member, and the slide member functions as a guide for transporting a recording material.

According to the described arrangement, the slide member slides so as to open and close the portion above the control electrode interlocking with the rotating movement of the opening and closing member. Here, as the slide member functions as the guide means for guiding a transportation of the recording material, a need of separately providing a guide can be eliminated. As this permits the required number of components to be reduced, a reduction in the cost of the apparatus can be achieved.

The third image forming apparatus in accordance with the present invention having the arrangement of the first image forming apparatus is characterized in that the control electrode protection means is composed of a rotating member in which the holding member and the control electrode are integrally formed, and the rotating member rotates interlocking with the rotating operation of the opening and closing member.

According to the described arrangement, the rotating member in which the holding member and the control electrode are integrated rotates interlocking with the rotating operation of the opening and closing member. As a result, for example, when opening the opening and closing member, by the rotating of the rotating member the control electrode is displaced from the portion where the it is exposed otherwise. As a result, when opening and the opening and closing member, the control electrode can be prevented from having a direct contact with other members. On the other hand, for example, when closing the opening and closing member, the control electrode is placed in its original position in the path for the flying toner by the rotating of the rotating member.

According to the described arrangement, even in the case where there is not enough space above the control electrode 26, and the sliding head cover is difficult to be formed so as to cover the control electrode, by providing the described rotating member, the surface of the control electrode can be protected with ease. As this offers a simpler structure than the case of adopting the sliding member, the size of the apparatus can be made reduced.

The fourth image forming apparatus in accordance with the present invention having the arrangement of the first image forming apparatus is arranged such that the control electrode protection means is composed of a protecting member for protecting the control electrode by placing a printing section in which the holding member and the control electrode are integrated on a sloped placement surface formed inside of the protecting member, the protecting member is moved so as to close a portion above the control electrode and to make the printing section downwards interlocking with an opening operation of the opening and closing member and to open the portion above the control electrode and make the printing unit upwards interlocking with a closing operation of the opening and closing member.

According to the described arrangement, the printing section in which the holding member and the control electrode are integrated is placed inside the protecting member. Then, for example, when opening the opening and closing member, the protecting member is moved so as to close the portion above the control electrode. As a result, in an open state of the opening and closing member, the control electrode can be prevented from having a direct contact with other members.

On the other hand, for example, when closing the opening and closing member, the protecting member is moved so as to open the portion above the control electrode. As a result, the developing material can fly from the holding member to the counter electrode, thereby permitting a normal image forming operation.

Additionally, as the sloped surface for placing thereon the printing section is formed inside the protecting member, for example, when opening the opening and closing member, the printing section slides downwards by the movement of the protecting member interlocking with the opening operation, while, for example, when closing the opening and closing member, the printing section slides upwards by the movement of the protecting member interlocking with the closing operation.

Therefore, according to the described arrangement, even when, for example, the distance between the control electrode and the counter electrode is extremely short, the surface of the control electrode can be protected with ease.

The fifth image forming apparatus having the arrangement of the fourth image forming apparatus is characterized in that the protecting member functions as guide means for guiding a transportation of the recording material.

According to the described arrangement, a need of separately providing a guide can be eliminated. As this permits the required number of components to be reduced, a reduction in the cost of the apparatus can be achieved.

The sixth image forming apparatus in accordance with the present invention is characterized by including a holding member for holding a developing material; a counter electrode placed opposing the holding member; a control electrode for controlling a flying of the developing material by varying an electric field between the holding member and the counter electrode; a holding member storage vessel in which at least the holding member and the control electrode are integrated; and control electrode protection means which is moved interlocking with installing and removing operations of the holding member storage vessel with respect to the apparatus main body so as to protect a surface of the control electrode in a state where the holding member storage vessel is removed from an apparatus main body, and to permit the developing material held on the holding member to fly towards the counter electrode in a state where the holding member storage vessel is installed in the apparatus main body.

According to the described arrangement, when an electric field between the holding member and the counter electrode deviates by the control electrode, a flying of the developing material from the holding member to the counter electrode is controlled. At least the holding member and the control electrode are integrated into the holding member storage vessel which is detachably mounted to the apparatus main body. Here, when removing the holding member storage vessel from the apparatus main body, the control electrode protection means is moved so as to protect the surface of the control electrode interlocking with the removing operation. As a result, when removing the unit including, for example, the control electrode from the apparatus, the control electrode can be prevented from having a direct contact with a finger of the operator or other members, etc.

On the other hand, when installing the holding member storage vessel into the apparatus main body, the control electrode protection means is moved interlocking with the installing operation so as to allow the developing material to fly from the holding member to the counter electrode. As a result, the developing material can fly without being disturbed by the control electrode protection means, thereby performing a normal image forming operation.

Therefore, according to the described arrangement, the surface of the control electrode 26 can be prevented from having a direct contact with other member when carrying out various checking. As this prevents the surface of the control electrode from soiling or being damaged, a flying of the developing material can be controlled always under stable conditions, thereby maintaining desirable printing performances.

The seventh image forming apparatus of the present invention having the arrangement of the sixth image forming apparatus is characterized in that in the state where the holding member storage vessel is mounted to the apparatus main body, and a part of the control electrode protection means functions as guide means for guiding a transportation of the recording material.

According to the described arrangement, a need of separately providing a guide for guiding a transportation of a recording material can be eliminated. As this permits the required number of components to be reduced, a reduction in the cost of the apparatus can be achieved.

The eighth image forming apparatus having the arrangement of the sixth or seventh image forming apparatus is characterized in that the holding member storage vessel is electrically connected to the control electrode, and includes a connecter which can mate with a connecter formed in the apparatus main body.

According to the described arrangement, as the connector on the side of the holding member storage vessel mates with the connecter on the side of the apparatus main body, the control electrode can be electrically connected to the apparatus main body, and the holding member storage vessel can be installed to the apparatus main body under stable conditions. Therefore, with this simple structure, the holding member storage vessel can be installed under stable conditions, respective exchange operations of the control electrode and the holding member can be performed with ease.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the instant contribution to the art and, therefore, such adaptations should and are intended to be comprehended within the meaning and range of equivalence of the appended claims.

What is claimed is:

1. An image forming apparatus, comprising:

an apparatus main body, said apparatus main body being adapted for selective movement to and from a closed position from and to an open position;

a holding member for holding a developing material;

a counter electrode placed opposing said holding member at least when said apparatus main body is in said closed position;

a control electrode located between said holding member and said counter electrode at least when said apparatus main body is in said closed position, said control electrode being adapted for controlling a flying of said developing material by varying an electric field between said holding member and said counter electrode;

an opening and closing mechanism capable of opening and closing said apparatus main body; and control electrode protection means for selectively protecting a surface of said control electrode, said control electrode protecting means being adapted to move into a protection position which protects a surface of the control electrode as said apparatus main body is moved from said closed position to said open position by said opening and closing mechanism, and being adapted to move out of said protection position as said apparatus main body is moved from said open position to said closed position by said opening and closing mechanism, wherein, when said apparatus main body is in said closed position, said opening and closing mechanism and said control electrode protection means are positioned relative to one another such that control of the flying of the developing material under the control of the control electrode may proceed without interference by either said opening and closing mechanism or said control electrode protection means.

2. The image forming apparatus as set forth in claim 1, wherein:

said opening and closing mechanism is an opening and closing member mounted in said apparatus main body so as to be capable of movement between an open position and a closed position.

3. The image forming apparatus as set forth in claim 2, wherein:

said opening and closing member is integrated with said counter electrode.

4. The image forming apparatus as set forth in claim 2, wherein:

said control electrode protection means is composed of a slide member which slides interlocking with the movement of said opening and closing member between said open position and said closed position for opening and covering the surface of said control electrode respectively.

5. The image forming apparatus as set forth in claim 4, wherein:

said slide member is made of a material having an electrical resistivity of not less than $10^{10}\Omega\cdot$cm under high temperature and high humidity.

6. The image forming apparatus as defined in claim 4, wherein:

said slide member is positioned in a transport path of a recording material in a closed state of said opening and closing member and functions as guide means for guiding a transportation of the recording material.

7. The image forming apparatus as set forth in claim 6, wherein:

said slide member is made of a material having an electrical resistivity of not more than $10^{8}\Omega\cdot$cm under ordinary temperature and ordinary humidity.

8. The image forming apparatus as set forth in claim 4, further comprising:

guide means for guiding a transportation of a recording material, wherein said slide member completes sliding movement interlocking with a movement of said opening and closing member to said closed position thereof when one side face of said slide member contacts a side face of said guide means on a side of said slide member.

9. The image forming apparatus as set forth in claim 2, wherein:

said control electrode protection means includes control electrode moving means for moving said control electrode interlocking with movements of said opening and closing member between the open position and the closed position, and interlocking with the movement of said opening and closing member to the closed position, said control electrode moving means moves said control electrode to a position where said control electrode can control the flying of said developing material without having an interference, and interlocking with the movement of said opening and closing member to the open position, said control moving means moves said control electrode to a position where the surface of said control electrode is in behind a cover member.

10. The image forming apparatus as set forth in claim 9, wherein said control electrode moving means includes:

a rotatable unit in which said holding member and said control electrode are integrated, and a linkage mechanism for rotating said rotatable unit interlocking with movement of said opening and closing member between said open position thereof and said closed position thereof.

11. The image forming apparatus as set forth in claim 10, wherein:

said holding member is provided so as to be capable of rotating, and said rotating member is coaxially formed with said holding member.

12. The image forming apparatus as set forth in claim 9, wherein:

said cover member is a guide member for guiding a transportation of the recording material.

13. The image forming apparatus as set forth in claim 2, further comprising:

a printing unit in which said holding member and said control electrode are integrated, wherein said control electrode protection means includes a protecting member which moves so as to open and cover said surface of said control electrode interlocking with movement of said opening and closing member between said open position thereof and said closed position thereof, and makes said print unit slide in a different direction from a moving direction of said control electrode, and said protecting member activates a downward sliding movement of said printing unit interlocking with movement of said opening and closing member to said open position thereof where said surface of said control electrode is covered, while said protecting member activates an upward sliding movement of said printing unit interlocking with movement of said opening and closing member to said closed position thereof where said surface of said control electrode is open.

14. The image forming apparatus as set forth in claim 13, wherein:

a portion of said protecting member, which moves so as to open and cover the surface of said control electrode, is made of a material having an electric resistivity value of not less than $10^{10}\Omega\cdot$cm under high temperature and high humidity.

15. The image forming apparatus as set forth in claim 13, wherein said protecting member includes:

a placement section having a sloped placement surface for placing thereon said printing unit, an opening and closing section for opening and closing a portion above said control electrode of said printing unit placed on said placement section, said opening and closing section being formed above said placement section to be integrated therewith; and a linkage mechanism for moving said placement section and said opening and closing section which are formed in one integral part in directions of opening and closing said opening and closing section interlocking with movement of said opening and closing member between said open position thereof and said closed position thereof.

16. The image forming apparatus as set forth in claim 15, wherein:

said protecting member further includes a guide member for guiding a sliding movement of said printing unit.

17. The image forming apparatus as defined in claim 13, wherein:

said protecting member is positioned in a transport path of a recording material in a closed state of said opening and closing member and functions as guide means for guiding a transportation of the recording material.

18. The image forming apparatus as set forth in claim 17, wherein:

a portion of said protecting member, which functions as said guide means is made of a material having an electrical resistivity of not more than $10^{8}\Omega\cdot$cm under normal temperature and normal humidity.

19. The image forming apparatus as set forth in claim 1, wherein:

said opening and closing mechanism is a unit mounted in the apparatus main body so as to be detachable, in which at least said control electrode is integrated, and said control electrode protection means is moved interlocking with installing and removing operations of said unit with respect to the apparatus main body so as to protect said surface of the control electrode in a state where said unit is removed from the apparatus main body while allowing said developing material held on said holding member to fly towards said counter electrode in a state where said unit is installed in the apparatus main body.

20. The image forming apparatus as set forth in claim 19, wherein:

said unit is a holding member storage vessel in which at least said holding member and said control electrode are integrated.

21. The image forming apparatus as set forth in claim 20, further comprising:

pushing means for pushing said counter electrode towards said holding member storage vessel, wherein said counter electrode and said holding member storage vessel are always in contact with one another by way of said pushing means and a spacer formed at such a position where transportation of the recording material is not disturbed.

22. The image forming apparatus as set forth in claim 19, wherein:

said control electrode protection means is integrated with said unit.

23. The image forming apparatus as set forth in claim 19, wherein:

said control electrode protection means includes a shutter which is capable of moving between a closed position where said surface of said control electrode is covered and an open position where said surface of the control electrode i s exposed;

pushing means for pushing said shutter to a closed position in the state where said unit is removed from the apparatus main body; and a guide member formed on a side of the apparatus main body, for guiding a movement of said shutter to the open position interlocking with an installing operation of said unit into said apparatus main body while maintaining a contact with said shutter.

24. The image forming apparatus as set forth in claim 23, wherein:

said holding member is formed so as to be capable of rotating, and said shutter is coaxially formed with said holding member so as to be capable of rotating.

25. The image forming apparatus as set forth in claim 19, wherein:

in the state where said unit is installed in the apparatus main body, a part of said control electrode protection means serves as guide means for guiding a transportation of the recording material.

26. The image forming apparatus as set forth in claim 19, further comprising:

a first connector mounted in the apparatus main body; and a second connector mounted in said unit, said second connector being electrically connected to said control electrode, wherein said first connector can mate with said second connector.

27. The image forming apparatus as set forth in claim 26, wherein:

said unit includes a high voltage driver which is held by said second connector, said unit is electrically connected with said control electrode by said high voltage driver, and said high voltage driver is detachably mounted in the apparatus main body.

28. An image forming apparatus, comprising:

an apparatus main body, said apparatus main body being adapted for selective movement to and from a closed position from and to an open position;

a holding member for holding developing material;

a counter electrode placed opposing said holding member at least when said apparatus main body is in said closed position, said counter electrode having an apparatus opening and closing member integrally formed therewith;

a control electrode located between said holding member and said counter electrode at least when said apparatus main body is in said closed position, said control electrode being adapted for controlling a flying of the developing material by varying an electric field between said holding member and said counter electrode; and control electrode protection means for selectively protecting a surface of said control electrode, said control electrode protecting means being (i) axially supported so as to be capable of rotational movement relative to said apparatus main body, (ii) adapted to move into a protection position which protects a surface of the control electrode as said apparatus main body is moved from said closed position to said open position by said opening and closing member, and (iii) being adapted to move out of said protection position as said apparatus main body is moved from said open position to said closed position by said opening and closing member, wherein, when said apparatus main body is in said closed position, said apparatus opening and closing member and said control electrode protection means are positioned relative to one another such that control of the flying of the developing material under the control of the control electrode may proceed without interference by either said apparatus opening and closing member or said control electrode protection means.

29. The image forming apparatus as set forth in claim 28, wherein:

said control electrode protection means is made of a slide member which slides so as to open and close a portion above said control electrode interlocking with a rotating movement of said opening and closing member, and said slide member also functions as guide means for guiding a transportation of a recording material.

30. The image forming apparatus as set forth in claim 28, wherein:

said control electrode protection means is composed of a rotating member in which said holding member and said control electrode are integrally formed, and said rotating member rotates interlocking with a rotating movement of said opening and closing member.

31. The image forming apparatus as set forth in claim 28, wherein:

said control electrode protection means is composed of a protecting member for protecting said control electrode by placing a printing section on a sloped placement surface formed inside of said protecting member, said printing section having formed therein said holding member and said control electrode;

said protecting member is moved so as to close a portion above said control electrode and to make said printing section slide downwards interlocking with an opening operation of said opening and closing member and to open the portion above said control electrode and make said printing unit slide upwards interlocking with a closing operation of said opening and closing member.

32. The image forming apparatus as set forth in claim 31, wherein:

said protecting member also functions as guide means for guiding a transportation of the recording material.

33. An image forming apparatus, comprising:

an apparatus main body, said apparatus main body being adapted for selective movement to and from a closed position from and to an open position;

a holding member for holding a developing material;

a counter electrode placed opposing said holding member at least when said apparatus main body is in said closed position;

a controlling electrode located between said holding member and said counter electrode at least when said apparatus main body is in said closed position, said control electrode being adapted for controlling a flying of said developing material by varying an electric field between said holding member and said counter electrode;

a holding member storage vessel in which at least said holding member and said control electrode are integrated, said holding member storage vessel being adapted for installation in, and removal from, said apparatus main body; and control electrode protection means for selectively protecting a surface of said control electrode, said control electrode protecting means being (i) formed integrally with said holding member storage vessel, (ii) adapted to move into a protecting position which protects a surface of said control electrode as said holding member storage vessel is removed from the apparatus main body so as to protect said surface of said control electrode when said holding member storage vessel is not located within said apparatus main body, and (iii) adapted to move out of said protecting position as said holding member storage vessel is installed into said apparatus main body, wherein, when said holding member storage vessel is installed in said apparatus main body, said control electrode protection means is positioned such that control of the flying of the developing material under the control of said control electrode may proceed without interference.

34. The image forming apparatus as set forth in claim 33, wherein:

in the state where said holding member storage vessel is mounted to the apparatus main body, and a part of said control electrode protection means functions as guide means for guiding a transportation of the recording material.

35. The image forming apparatus as set forth in claim 33, wherein:

said holding member storage vessel is electrically connected to the control electrode, and includes a connecter which can mate with a connecter formed in the apparatus main body.

* * * * *